US005981157A

United States Patent [19]

Tanaka et al.

[11] Patent Number: 5,981,157

[45] Date of Patent: Nov. 9, 1999

[54] SILVER HALIDE LIGHT-SENSITIVE COLOR PHOTOGRAPHIC MATERIAL

[75] Inventors: Shinri Tanaka; Michiko Nagato, both of Hino, Japan

[73] Assignee: Konica Corporation, Japan

[21] Appl. No.: 08/773,201

[22] Filed: Dec. 23, 1996

[30] Foreign Application Priority Data

| | | | |
|---|---|---|---|
| Dec. 27, 1995 | [JP] | Japan | 7-351811 |
| Feb. 29, 1996 | [JP] | Japan | 8-069424 |
| Sep. 30, 1996 | [JP] | Japan | 8-278753 |

[51] Int. Cl.[6] ..... G03C 1/08; G03C 7/26; G03C 7/32

[52] U.S. Cl. ..... 430/544; 430/555; 430/955; 430/956; 430/957; 430/958; 430/959; 430/960; 430/543

[58] Field of Search ..... 430/543, 555, 430/955, 956, 957, 958, 959, 960

[56] References Cited

U.S. PATENT DOCUMENTS

| | | | |
|---|---|---|---|
| 3,227,554 | 1/1966 | Barr et al. | 430/543 |
| 4,264,723 | 4/1981 | Ichijima et al. | 430/555 |
| 4,584,266 | 4/1986 | Hirose et al. | 430/555 |
| 5,576,166 | 11/1996 | Sugita et al. | 430/555 |
| 5,702,877 | 12/1997 | Odenwalder et al. | 430/555 |

FOREIGN PATENT DOCUMENTS

| | | |
|---|---|---|
| 0730197 | 4/1996 | European Pat. Off. . |
| 944838 | 12/1960 | United Kingdom . |

*Primary Examiner*—Geraldine Letscher
*Attorney, Agent, or Firm*—Jordan B. Bierman; Bierman, Muserlian & Lucas

[57] ABSTRACT

A silver halide light-sensitive color photographic material comprising containing a coupler is disclosed. The coupler is represented by formula (VII):

(VII)

wherein PUG represents a photographically useful group; R represents a substituent; m represents an integer from 1 to 5; and n represents zero or an integer from 1 to 4, wherein the coupler has a group represented by formula (VII a) at a position other than active point of the coupler, (VII a)

8 Claims, No Drawings

SILVER HALIDE LIGHT-SENSITIVE COLOR PHOTOGRAPHIC MATERIAL

FIELD OF THE INVENTION

The invention relates to a silver halide light-sensitive color photographic material, hereinafter also referred to simply as "light-sensitive material". More specifically, the invention pertains to a silver halide light-sensitive color photographic material with reduced bleach fogging and enhanced sensitivity and color density, whereby reduction of the film thickness is possible; having excellent light resistance and color reproduction-property; with reduced pH fluctuation during developing process. In addition, by the use thereof, cost-saving is possible and thus improvement of photographic properties, which has heretofore been dependent upon photographic additives, can be performed easily and efficiently.

BACKGROUND OF THE INVENTION

Presently in the silver halide light-sensitive color photographic material (hereinafter referred to as "light-sensitive material"), reduction color process is employed and a color image is produced by combination of three kinds of dyes derived from yellow-dye-forming couplers, magenta-dye-forming couplers and cyan-dye-forming couplers.

For the magenta dye-forming coupler, which has popularly used in the conventional silver halide light-sensitive photographic materials, pyrazolone-, pyrazolotriazole, pyrazolino benzimidazole- or indanone-type couplers are known and, among these, various types of 5-pyrazolone derivatives are widely used.

For the substituent on the 3-position of the 5-pyrazolone ring in the above-mentioned 5-pyrazolone derivatives, for example, alkyl groups, aryl groups, alkoxy groups described in U.S. Pat. No. 2,439,098, acylamino groups described in U.S. Pat. Nos. 2,369,489 and 2,600,788, and ureide groups described in U.S. Pat. No. 3,558,319 are used. However, these couplers have such defects that they have relatively low coupling activity with the oxidation product of the developing agent and, accordingly, magenta dye images with high density may hardly be obtainable; that density fluctuation of the developed dye image depending on the kind of developer or pH of the developing solution is large; that secondary absorption in the blue color spectrum range is large and that absorption cut in the longer wavelength side of the main absorption is dull; etc.

Further, 3-anilino-5-pyrazplone-type couplers described in U.S. Pat. Nos. 2,311,081, 3,677,764 and 3,684,514, and British Patent Nos. 956,261 and 1,173,513, etc. have advantages that they have relatively high coupling activity and developed color density is high; and that the secondary absorption in the blue color spectrum range is small. However, the main absorption of the dyes obtainable from these conventionally known 3-anilino-5-pyrazolone-type couplers reside relatively in the shorter wavelength side and, therefore, color reproduction performance tends to be degraded. However, coloring performance of this type of coupler is not sufficient yet. Thus, there is a disadvantage that coloring reaction still takes place even after the light-sensitive material is conveyed to a bleaching bath from the developing bath and, as a result, coloring takes place even in the non-image portion, which is so-called "bleach-fogging".

In order to reduce bleach fogging, use of a certain additive has been proposed. For example, a technology of reducing the bleach fogging by the use of aniline derivatives has been disclosed in Japanese Patent O.P.I. Publication No. 58-105147/1983. However, according to our investigation, it is necessary for the above-mentioned additive to be incorporated approximately at an equivalent molar amount to that of the coupler and, therefore, there is a problem that film thickness necessarily be increased to that extent. Moreover, it was found that, by the use of the above-mentioned additive, not only coloring performance per amount of oil is lowered, but coloring performance per added amount of coupler is also lowered in view of improvement of sharpness and reduction in costs.

As couplers having in their molecules a photographically useful group, which is hereinafter referred to as PUG as well, a development inhibitor releasing coupler (DIR coupler), a development scavenger releasing coupler (DSR coupler), a bleach accelerator releasing coupler (BAR coupler), etc. are well known in the art. Respective of these couplers has a PUG on the group which is released upon reaction with the oxidation product of a developing agent, which is hereinafter referred to as an "active point substituent". In the case of the DIR coupler, for example, an oxidation product of the developing agent is reacted with a coupler, while a development inhibitor residing on the active point substituent group came into play on the neighboring silver halide, restricting development, to obtain required photographic property. In the case of these couplers, it is necessary for the PUG to reside on the active point substituent group and in this respect, they are different from couplers having PUG on the point other than active substituting point.

Japanese Patent O.P.I. Publication No. 63-23855/1988 discloses a coupler having a 2-alkoxyphenylthio group on 4-position of pyrazolone and having partially a similar molecular structure as that of the present invention. However, sensitivity and coloring performance of those couplers are still insufficient. Moreover, in spite of the description in the specification, there is defect that lowering in coloring performance when the coupler is processed with a color developing solution containing an alkaline earth metal compound has not sufficiently been overcome, and improvement in this respect has been awaited. There is neither any clear references to couplers having a photographically useful group according to the present invention nor any description implying this. In other words, there is no reference as to superiority of having such the photographically effective group on the position other than the active point. In fact, in the specification of this reference, couplers in which such photographically useful group is on the active point and on the point other than the active point are both dealt on the same rank. In the specification of this reference, among compounds which are neither included in the preferable examples8 nor described in the working examples, compounds having partially common structure of the compounds according to the present invention are occasionally found, however, they had a problem either in sensitivity or coloring performance and, therefore, they were not preferable compounds.

SUMMARY OF THE INVENTION

The first objective of the present invention is to provide a silver halide light-sensitive color photographic material having enhanced sensitivity.

The second objective of the invention is to provide a silver halide light-sensitive color photographic material having excellent color reproduction property and light stiffness.

The third objective of the invention is to provide a silver halide light-sensitive color photographic material having reduced film thickness and excellent image sharpness.

The fourth objective of the invention is to provide a silver halide light-sensitive color photographic material having reduced pH fluctuation during development.

The fifth objective of the invention is to provide a silver halide light-sensitive color photographic material at reduced costs.

The sixth objective of the invention is to provide a silver halide light-sensitive color photographic material, by which photographic property improvement effects can be obtained more efficiently.

The silver halide light-sensitive color photographic material of the invention is listed.

1 A silver halide light-sensitive color photographic material comprising on a support photographic constituent layers including a blue-sensitive silver halide emulsion layer, a green-sensitive silver halide emulsion layer and a red-sensitive silver halide emulsion layer, wherein at least one of the photographic constituent layers contain at least one coupler represented by following general formula (VII):

General Formula (VII)

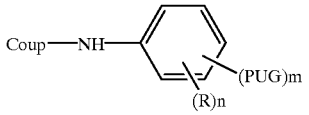

wherein Coup represents a coupler residue capable of releasing a group other than an arylthio group substituted by an alkoxy group; PUG represents a photographically useful group; R represents a substituent; m represents an integer from 1 to 5; and n represents zero or an integer from 1 to 4.

2 The silver halide light-sensitive color photographic material described in Item No. 1, wherein Coup is a pyrazolone-type groups or 1,3-diketone-type groups.

3 The silver halide light-sensitive color photographic material described in Item No. 1, wherein PUG is an anti-fading agent or a anti-bleach fogging agent.

4 The silver halide light-sensitive color photographic material described in Item No. 1, wherein Coup is a group represented by formula

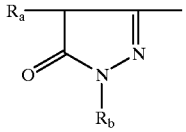

wherein $R_a$ is a group which is capable of splitting off upon reaction with an oxidation product of a developing agent; and $R_b$ represents a non-substituted or substituted aromatic group.

5 The silver halide light-sensitive color photographic material described in Item No. 4, wherein $R_a$ is an arylthio group which may have a substituent.

6 The silver halide light-sensitive color photographic material described in Item No. 4, wherein $R_b$ is a group represented by formula

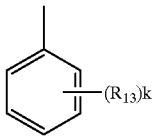

$R_{13}$ represents a substituent group and k represents 4 or 5, provided that when $(R_{13})m$ represents at least four halogen atoms.

7 The silver halide light-sensitive color photographic material described in Item No. 5, wherein $R_a$ is an arylthio group substituted by an acylamino group.

8 The silver halide light-sensitive color photographic material described in Item No. 5, wherein $R_b$ is a pentachlorophenyl group.

9 The silver halide light-sensitive color photographic material described in Item No. 6, wherein R is a group containing a benzoyl group or a benzoylamino group.

10 The silver halide light-sensitive color photographic material described in Item No. 6, wherein PUG is a group represented by a formula:

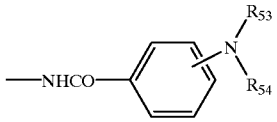

wherein $R_{53}$ and $R_{54}$ independently represent an alkyl group or an aryl group.

11 A silver halide light-sensitive color photographic material comprising on a support photographic constituent layers including a blue-sensitive silver halide emulsion layer, a green-sensitive silver halide emulsion layer and a red-sensitive silver halide emulsion layer, wherein at least one of the constituent layers contains at least one coupler represented by the following general formula (V):

General Formula (V)

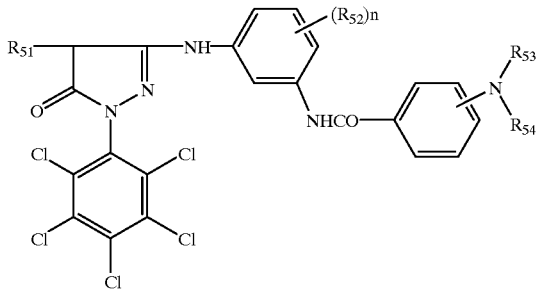

wherein $R_{51}$ represents an arylthio group; $R_{52}$ represents an alkoxy group or a halogen atom; $R_{53}$ and $R_{54}$ independently represent an alkyl group or an aryl group and n represents an integer from zero to four.

12 A silver halide light-sensitive color photographic material comprising on a support a blue-sensitive silver halide emulsion layer, a green-sensitive silver halide emulsion layer and a red-sensitive silver halide emulsion layer, wherein at least one of silver halide emulsion layer contains a coupler represented by General Formula (I):

General Formula (I)

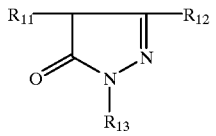

wherein $R_{11}$ represents a group which is capable of splitting off upon reaction with an oxidation product of a developing agent; $R_{12}$ represents a group selected from a group consisting of anilino group, an acylamino group, a group containing a tertiary amine and a ureido group, pKa value of whose conjugate acid is from 5 to 10; $R_{13}$ represents a non-substituted or substituted aromatic group.

13 The silver halide light-sensitive color photographic material described in Item No. 12, wherein $R_{11}$ is an arylthio group.

14 The silver halide light-sensitive color photographic material described in Item No. 12, wherein $R_{12}$ is an anilino group.

15 The silver halide light-sensitive color photographic material described in Item No. 12, wherein $R_{12}$ is a group containing a tertiary amine.

16 The silver halide light-sensitive color photographic material described in Item No. 12, wherein $R_{12}$ is an anilino group, an acylamino group or ureido group each of which is substituted by a dialkylaniline group.

17 The silver halide light-sensitive color photographic material described in Item No. 12, wherein $R_{12}$ is an anilino group, an acylamino group or ureido group each of which is substituted by a benzoylamino group.

18 The silver halide light-sensitive color photographic material described in Item No. 17, wherein $R_{12}$ is a group represented by a formula:

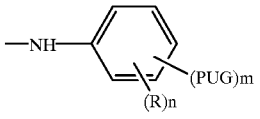

PUG represents a photographically useful group; R represents a substituent; m represents an integer from 1 to 5; and n represents zero or an integer from 1 to 4.

19The silver halide light-sensitive color photographic material described in Item No. 12, wherein PUG is an anti-fading agent or a anti-bleach fogging agent.

20 The silver halide light-sensitive color photographic material described in Item No. 18, wherein PUG is a group A represented by a formula:

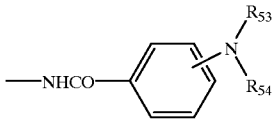

wherein $R_{53}$ and $R_{54}$ independently represent an alkyl group or an aryl group.

DETAILED DISCLOSURE OF THE INVENTION

Below preferable embodiments of the present invention is explained more in detail.

The pKa value referred in the present invention denotes a value when a sample, of which concentration is 15 mg/ml in ethanol-water (80:20 in volume) mixed solvent under conditions at 25° C., 1 atmospheric air pressure, is titrated from an acid side ($6\times10^{-3}$ normal hydrochloric acid) to basic side using a $6\times10^{-2}$ normal aqueous sodium hydroxide solution.

It is preferable in light of anti-bleach fogging that at least one pKa value of a point of the coupler used in the invention derived from the point other than the active point of coupler is not less than 5. This is the same as the pKa value of conjugate acid which is formed by a coupler releasing a splitting off group from the active point of the coupler. More preferably, the pKa value is not less than 6 and, most preferably, it is not less than 7.

It is preferable to use a two-equivalent coupler, which has at least one pKa value derived from a point other than the active point of said coupler, in light of reduced bleach fogging, good coloring performance and small pH fluctuation during development.

Also, it is preferable that $R_{12}$ of (I) has a substituent, of which pKa value is not smaller than 5 and not greater than 10, when the effects of the invention may be obtainable most remarkably.

Further, it is preferable in light of coloring performance and sensitivity that each of $R_{11}$ of (I) and $R_{51}$ of (V) is an arylthio group, to the ortho position of the sulfur atom of which has been substituted by an acylamino group.

Still further, it is preferable in light of easy obtaining of the effects of the invention that each of $R_{12}$ and is an anilino group or an acylamino group and, most advantageously, they are arylthio groups in light of coloring performance and sensitivity.

Still further, it is preferable in light of lowering bleach fogging that each of $R_{12}$ is substituted by a dialkyl aniline.

Still further, it is preferable in light of good coloring performance that each of $R_{12}$ is substituted by a benzoylamino group.

Still further, it is preferable in light of color reproduction that $R_a$ is a phenyl group, more preferably, a phenyl group on which four or more chlorine atoms have been substituted and, most advantageously, a phenyl group on which five chlorine atoms have been substituted.

Still further, it is preferable in light of color reproduction performance and sensitivity that $R_{52}$ of (V) is an alkoxy group or a chlorine atom, more preferably, a methoxy group or a chlorine atom and, most advantageously, it is a chlorine atom.

Still further, it is necessary in light of reduced bleach fogging that each of $R_{53}$ and $R_{54}$ of (V) is an alkyl group or an aryl group. It is preferable that it is an alkyl group. More preferably, it is an alkyl group having six or less carbon atoms and, most advantageously, it is a methyl group.

Still further, it is preferable to use a two-equivalent coupler which has at least one pKa value derived from a point other than the active point of the coupler and its value is greater than that derived from the active point and not greater than 10.

It is preferable in light of obtaining the effect of the invention more remarkably that $R_{12}$ is a substituent having a pKa value not smaller than 5 and not greater than 10.

It is preferable in light of coloring performance and sensitivity that $R_{11}$ is an arylthio group in which an acylamino group has been substituted on the ortho position of the sulfur atom.

Also, it is preferable in light of obtaining easily the effect of the invention that $R_{12}$ is an anilino group or an acylamino group,. and it is preferable in light of sensitivity and coloring performance that each of them is an anilino group.

Further, it is preferable in light of reducing bleach fogging that $R_{12}$ is substituted by a dialkylaniline.

Still further, it is preferable in light of coloring performance that each of $R_{12}$ is substituted by a benzoylamino group.

It is preferable in light of color reproduction and sensitivity that $R_{52}$ of (V) is an alkoxy group or a halogen atom. More preferably, it is a methoxy group or a halogen atom and, most advantageously, it is a halogen atom.

Further, in light of reducing bleach fogging, it is preferable for each of $R_{53}$ and $R_{54}$ is an alkyl group or an aryl group. More preferably, they are respectively an alkyl group. More preferably, they are alkyl group having six or less carbon atoms. Most preferably they are both methyl groups.

n represents zero or an integer of 1–4. In light of color reproduction, 1 is preferable.

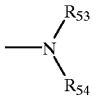

is preferably substituted at meta position with respect to —NHCO— of the joint portion.

$R_{52}$ represents a halogen atom or an alkoxy group. As for the halogen atom, chlorine atom, bromine atom, fluorine atom, etc. can be mentioned. As for the example of the alkoxy group, methoxy group, ethoxy group, isopropyloxy group, t-butyloxy group, hexyloxy group, methoxyethyloxy group, etc. can be mentioned. Preferable examples of the coupler is represented by a formula;

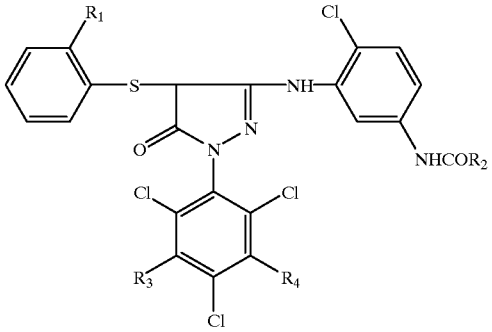

wherein $R_1$ is a substituent, each of $R_3$ and $R_4$ is a hydrogen atom or a chlorine atom, and $R_2$ is a phenyl group having a group

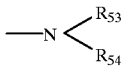

Each of $R_{53}$ and $R_{54}$ is an alkyl group or an aryl group. More preferably, they are respectively an alkyl group. More preferably, they are alkyl group having six or less carbon atoms. Most preferably they are both methyl groups. Preferable examples of $R_2$ is listed.

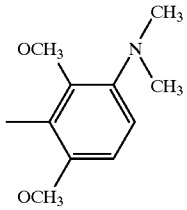

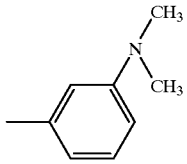

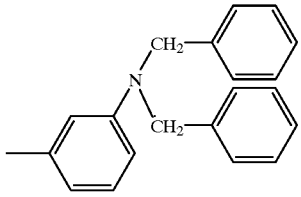

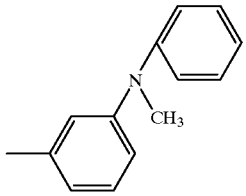

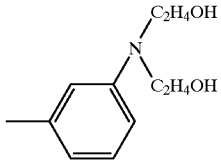

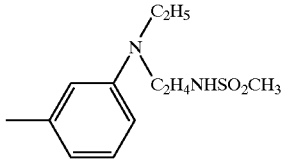

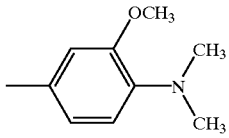

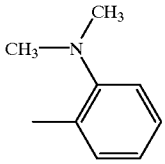

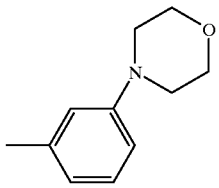

-continued
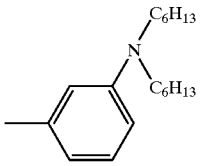
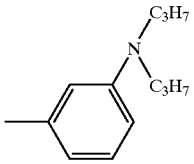
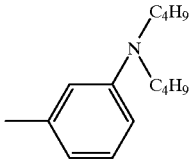
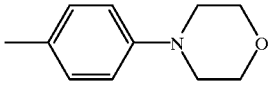
-continued
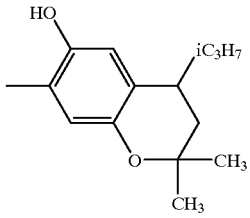
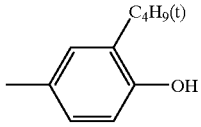
and
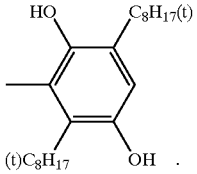
Representative examples of the magenta dye-forming couplers are given.
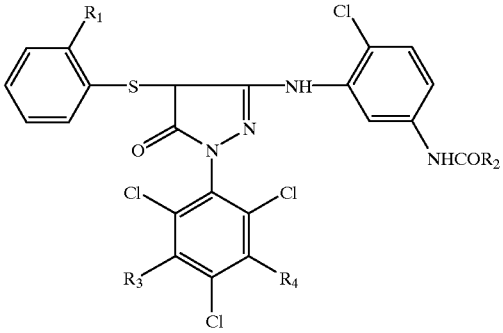
| No. | $R_1$ | $R_2$ | $R_3$ | $R_4$ |
|---|---|---|---|---|
| 1 | 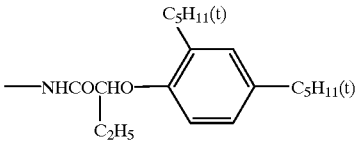 | 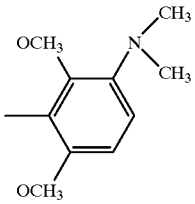 | Cl | Cl |

-continued
| | | | | |
|---|---|---|---|---|
| 2 | 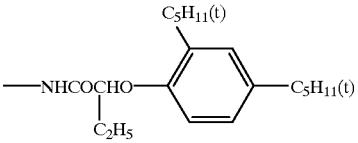 | 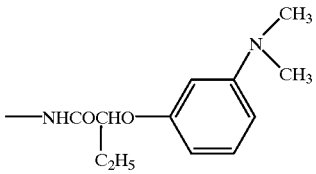 | Cl | Cl |
| 3 | 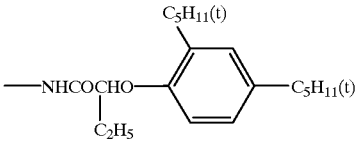 | 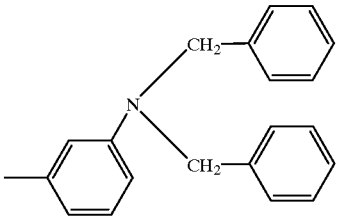 | Cl | Cl |
| 4 | 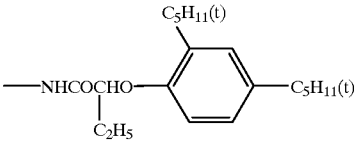 | 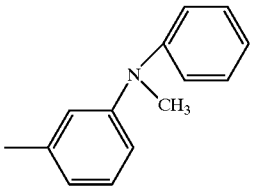 | Cl | Cl |
| 5 | 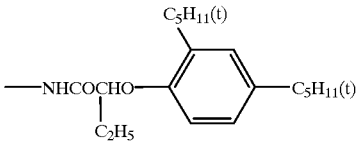 | 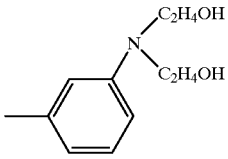 | Cl | Cl |
| 6 | 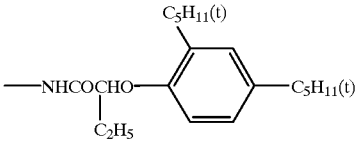 | 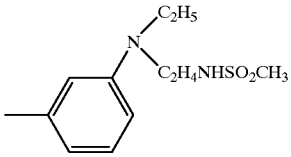 | Cl | Cl |
| 7 | $—NHCOC_{13}H_{27}$ | 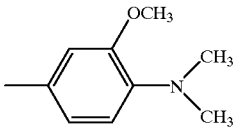 | Cl | Cl |
| 8 | $—NHCOC_{13}H_{27}$ | 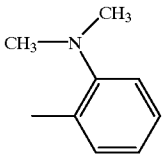 | Cl | Cl |
| 9 | 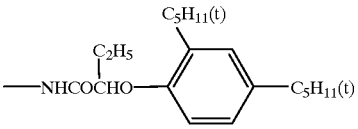 | 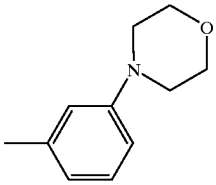 | H | H |

-continued
| | | | | |
|---|---|---|---|---|
| 10 | 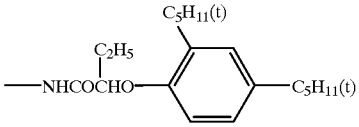 | 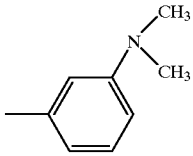 | H | H |
| 11 | 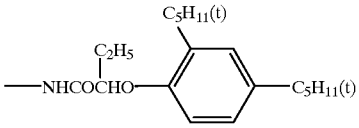 | 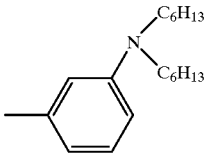 | Cl | Cl |
| 12 | 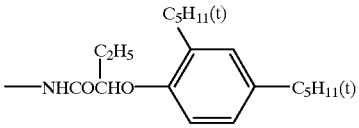 | 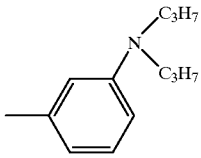 | Cl | Cl |
| 13 | 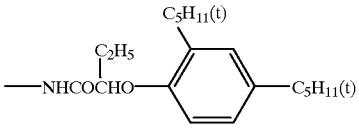 | 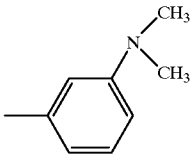 | Cl | H |
| 14 | 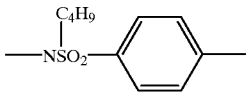 | 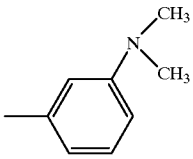 | Cl | Cl |
| 15 | 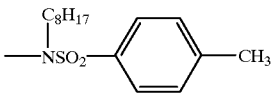 | 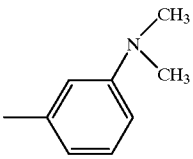 | Cl | Cl |
| 16 | 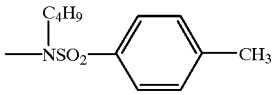 | 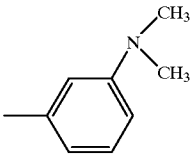 | H | H |
| 17 | 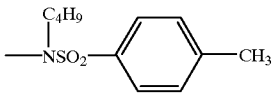 | 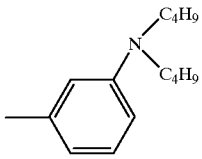 | H | H |
| 18 | 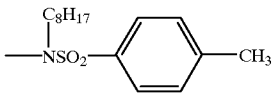 | 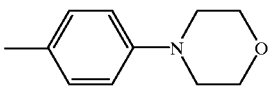 | Cl | Cl |

-continued
| | | | | |
|---|---|---|---|---|
| 19 | 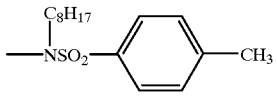 | 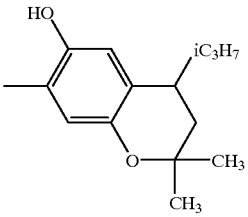 | H | H |
| 20 | 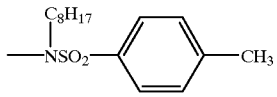 | 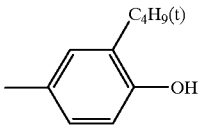 | H | H |
| 21 | 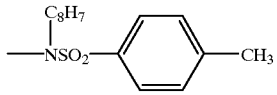 | 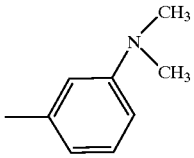 | Cl | Cl |
| 22 | 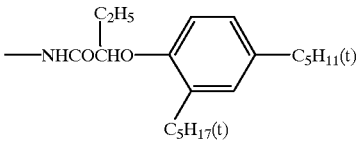 | 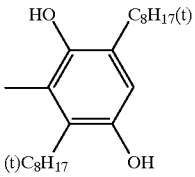 | Cl | Cl |
23
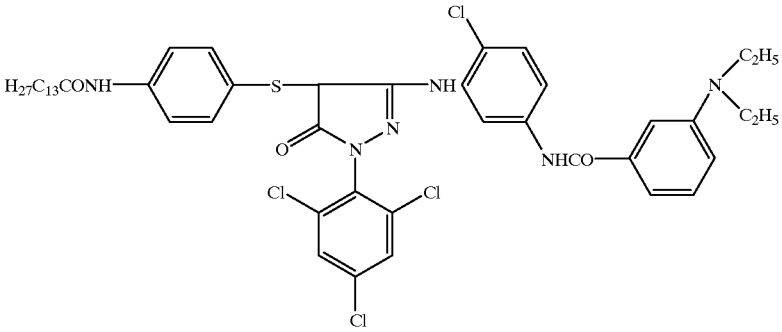
24
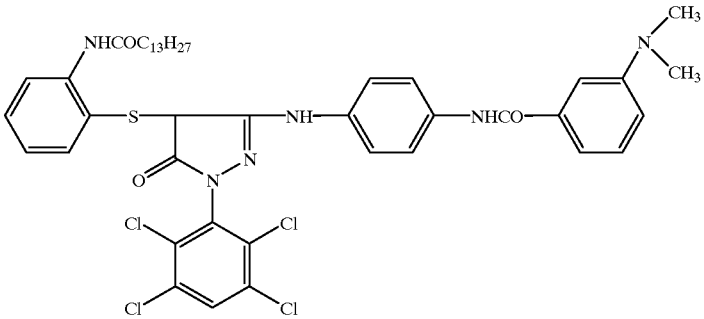

-continued
25
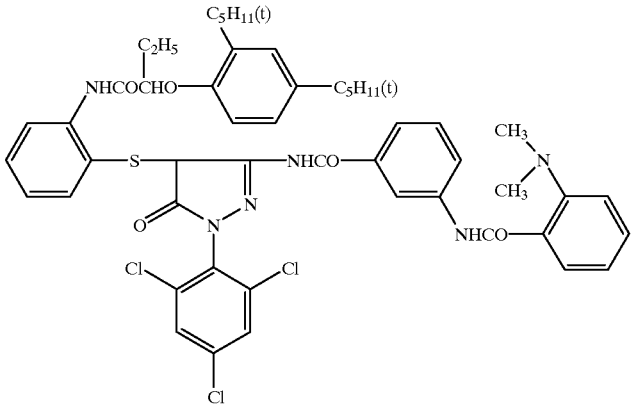
26
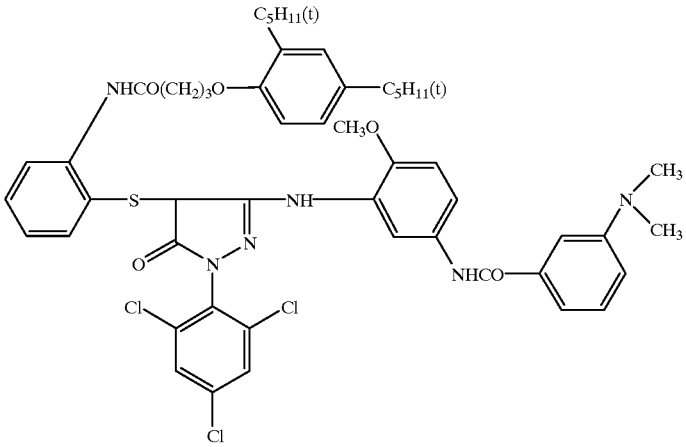
27
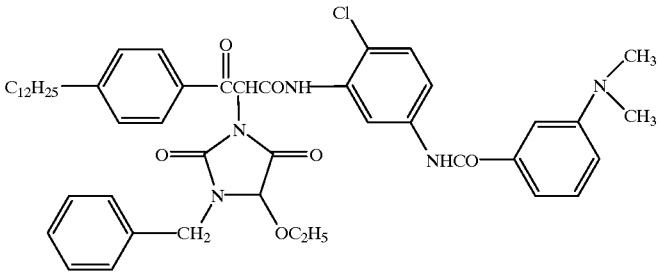
28
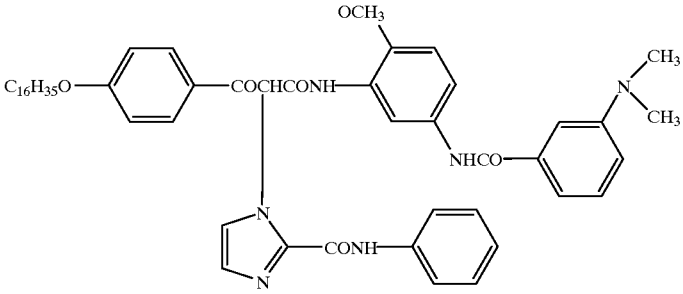

-continued

29

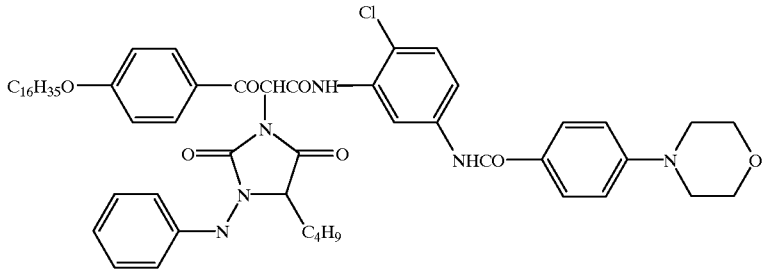

Next, Specific synthesizing examples of the magenta coupler are given. As to the general synthesizing method, it is disclosed, for example, in the U.S. Pat. Nos. 2,369,489; 2,376,380; 2,472,5781; 2,600,788; 2,933,391; 3,615,506; British Patent No. 956,261; 1,134,329; Japanese Patent publication No. 45-20636/1970; Japanese Patent O.P.I. Publication No. 2-39148/1989; etc. can be referred to.

Specific synthesis example of the magenta dye-forming coupler is given below.

Synthesis Example 1

Synthesis of Exemplified Compound 2

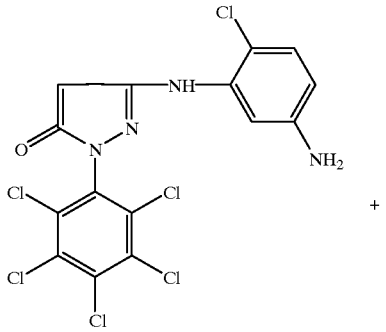

Compound 1

+

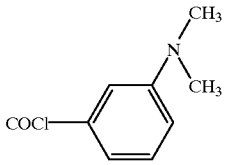

Compound 2

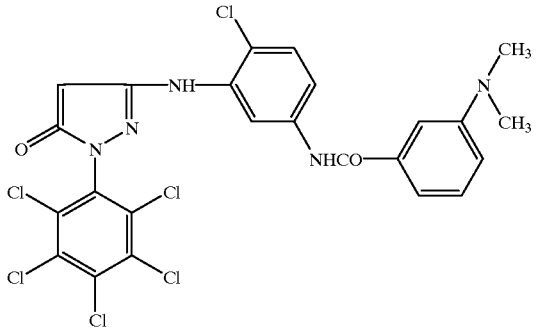

Compound 3

To 3.96 g of dimethylamino bebzoic acid, 20 ml of toluene and 3.41 g of thionyl chloride to undergo reaction for 1.5 hours in the room temperature. Then, thionyl chloride was removed by reflux under reduced pressure, to obtain a yellowish solid product (Compound 2). To 9.46 g of Compound 1, 43 ml of toluene, 16 ml of water and 10.4 g of acetic acid anhydride were added, and under agitation the whole amount of Compound 2 was added. After mixing for three hours, pH of the mixture was adjusted to 7.0, filtrate the precipitation, wash with water, and dry, to obtain 7.72 g (62%) of faint brownish powder (Compound 3). Chemical structure of Compound 3 was identified by NMR mass spectrometry and mass spectrometry. The melting point t of compound was higher than 300° C.

Compound 3 +

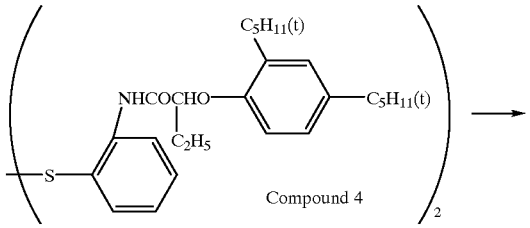

exemplified Compound 2

To 3.1 g of Compound 3, 6 ml of DMF, 21 ml of ethyl acetate, 2.35 g of Compound 4 and an aqueous solution of potassium carbonate, in which 1 g of potassium carbonate was dissolved in 4 ml of water and 0.03 g of hydrogen peroxide were added, to undergo reaction for 2 hours under the room temperature and, then, ethyl acetate was added and washed with water. The solvent was distilled out, filtratrated products which were insoluble in ethanol, removed the solvent in the dissolution medium, and this was recrystallized from ethyl acetate—toluene mixed solvent, to obtain 2.65 g of faint yellowish crystals, which is exemplified Compound 2. (Yield of production: 51%)

Chemical structure of Compound 2 was identified by mass spectrometry and NMR mass spectrometry. The melting point of the compounds was 240–242° C. Further, pKa of Compound 2 measured by the above-mentioned method was 8.8.

Other exemplified compounds can be synthesized in the similar manner. For example, melting point of Exemplified Compound 1 was 160–168° C.

The magenta dye-forming coupler which is represented by the general formula (I) is usually used in an amount per 1 moll of silver halide between $1\times10^{-3}$–$8\times10^{-1}$ mol and, preferably, between $1\times10^{-2}8\times10^{-1}$ mol.

The magenta dye-forming coupler, represented by the general formula (I) can be used together with the other type of magenta dye-forming coupler.

In order to incorporate the magenta dye-forming coupler represented by the general formula (I) in the silver halide light-sensitive color photographic material, conventional methods including, for example, a method whereby after solubilizing one or more kinds of the magenta dye-forming couplers represented by the general formula (I) in a mixed solvent consisting of a known high boiling point solvent such as dibutyl phthalate, tricresyl phosphate, etc., and a low boiling point solvent such as ethyl acetate, butyl acetate, etc., or solely in the low boiling point solvent. Then, after the mixture is mixed with an aqueous gelatin solution containing a surface active agent, and is subjected to emulsification and dispersion by the use of a high speed rotary mixer, a colloid mill or an ultrasonic distributor, this is added directly to a silver halide emulsion Further, a method, in which after the above-mentioned emulsion is set, cut and washed, this may be incorporated in the emulsion and incorporated.

The above-mentioned magenta dye-forming coupler represented by the general formula (I) and the high boiling point solvent can be incorporated in the silver halide emulsion after being subjected to emulsification separately, however it is preferable that both materials are dissolved, emulsified and incorporated in the silver halide emulsion simultaneously.

Preferable added amount of the above-mentioned high boiling point solvent with respect to 1 g of the magenta dye-forming coupler represented by the general formula (I) is 0.02–10 g and, more preferably, 0.1–3.0 g. Further, the magenta dye-forming coupler may be solved and dispersed solely in a low boiling point solvent without using a high boiling point solvent. And is incorporated in the silver halide emulsion.

Next, the invention described in claims 26 through 31 is explained.

The compound represented by the general formula (VII) is explained.

Among the compounds, Coup represents a group which is capable of coupling with an oxidation product of a developing agent and, preferably, the Coup is a pyrazolone or 1,3-diketone-type group. More preferably, it is a pyrazolone-type group.

In the present invention, the term "photographically useful group" denotes a group which is capable of exerting photographically preferable affect. Specifically, such photographic effects as anti-color fading effect, anti-bleach fogging effect which is a phenomenon that unfavorable coloring reaction takes place not only during development process of the light-sensitive material but also in a bleaching solution. Color image-preserving effect including anti-light durability and preservation performance in the dark place, tone adjusting effect, granularity improvement effect, etc. can be mentioned.

The photographically useful group (PUG) is connected to the magenta dye image-forming coupler which is not released from the coupler upon reaction with the oxidation product of the developing agent.

Although there is no specific limitation as to the photographically useful group, it is preferable in light of obtaining the effect of the present invention more remarkably to use a group having anti-bleach fogging effect or anti-color fading effect. Moreover, the compounds may either have a plurality of such photographically useful groups or a single photographically useful group having a plurality of functions.

It is preferable that the photographically useful group contains as a constituent a benzoylamino group.

R represents a substituent and there is no specific limitation as regards the nature of such substituent, however, in light of proper spectral absorption maximum wavelength of a dye produced by development, chlorine atom or an alkoxy group is preferable. M represents an integer from 1 to 5, and 1 is preferable. Most preferably, n is 1 and R is chlorine atom.

The magenta dye-forming coupler which is represented by the general formula (VII) is usually used in an amount per 1 moll of silver halide between $1\times10^{-3}$–$8\times10^{-1}$ mol and, preferably, between $1\times10^{-2}$–$8\times10^{-1}$ mol.

The magenta dye-forming coupler represented by the general formula (I) can be used together with the other type of magenta dye-forming coupler.

In order to incorporate the magenta dye-forming coupler represented by the general formula (I) in the silver halide light-sensitive color photographic material, conventional methods including, for example, a method whereby after solubilizing one or more kinds of the magenta dye-forming couplers represented by the general formula (I) in a mixed solvent consisting of a known high boiling point solvent such as dibutyl phthalate, tricresyl phosphate, etc., and a low boiling point solvent such as ethyl acetate, butyl acetate, etc., or solely in the low boiling point solvent. Then, after the mixture is mixed with an aqueous gelatin solution containing a surface active agent, and is subjected to emulsification and dispersion by the use of a high speed rotary mixer, a colloid mill or an ultrasonic distributor, this is added directly to a silver halide emulsion.

Further, a method, in which after the above-mentioned emulsion is set, cut and washed, this may be incorporated in the emulsion.

The above-mentioned magenta dye-forming coupler represented by the general formula (I) and the high boiling point solvent can be incorporated in the silver halide emulsion after being subjected to emulsification separately, however it is preferable that both materials are dissolved, emulsified and incorporated in the silver halide emulsion simultaneously.

Preferable added amount of the above-mentioned high boiling point solvent with respect to 1 g of the magenta dye-forming coupler represented by the general formula (I) is 0.02–10 g and, more preferably, 0.1–3.0 g. Further, the magenta dye-forming coupler may be solved and dispersed solely in a low boiling point solvent without using a high boiling point solvent. And is incorporated in the silver halide emulsion.

For the silver halide emulsion used in the light-sensitive color photographic material, any one which is conventionally used in the art may optionally be employed. The emulsion can undergoes chemical ripening by a conventional method and, also spectral sensitization to a required wavelength region using one or more spectral sensitizing dyes. To the silver halide emulsion, conventionally known photographic additives such as an anti- foggant, a stabilizing agent, etc. can be added. As a binder used for the silver halide emulsion, gelatin may advantageously be employed. The silver halide emulsion layer or other hydrophilic colloidal layers may be hardened. Also, these layers may be incorporated with other photographic additives such as a plasticizer, or polymer dispersion of a water insoluble or scarsely soluble dispersion of a polymer (latex). In the emulsion layer of light-sensitive color photographic materials, a dye-forming coupler is usually used.

Further, a colored coupler, which has a color compensation effect, competing coupler and compounds which are capable of releasing photographically useful fragments such as a development inhibitor, a development accelerator, a bleach accelerator, a developing agent, a silver halide solvent, a color toning agent, a hardening agent, a fogging agent, an anti-foggant, a chemical stabilizer, an optical sensitizer and a desensitizer.

As a support, paper laminated with polyethylene, a polyethylene terephthalate film, polynaphthalate film, baryta paper, cellulose triacetate, etc. can be used. In order to obtain a dye image using the silver halide light-sensitive color photographic material. Conventionally known color photographic process may be conducted.

EXAMPLE

Below, the invention is further explained with reference to working examples.

Example 1

Hereinbelow, added amount in the silver halide light-sensitive photographic material is given in terms of gram per a square meter of the silver halide light-sensitive photographic material, unless indicated otherwise. Regarding silver halide and colloidal silver, an amount converted into that of silver is shown. As to the sensitizing dye, it is given in terms of mol per one mol of silver.

One surfaces of a cellulose triacetate film was subjected to subbing treatment. Subsequently, on the opposite surface (rear surface) of the support with respect to said subbed surface, the following layers were coated in order, to prepare a support with subbing treatment. Herein, added amount is shown in terms of weight per 1 $m^2$.

| | |
|---|---|
| First layer (Rear surface) | |
| Alumina sol AS 100 (aluminum oxide) (a product of Nissan Chemical Industries, Co., Ltd.) | 0.1 g |
| Diacetyl cellulose | 0.2 g |
| Second layer (rear surface) | |
| Diacetyl cellulose | 100 mg |
| Stearic acid | 10 mg |
| Silica fine powder (average diameter: 0.2 $\mu$m) | 50 mg |

On one surface of a subbed cellulose triacetate film support, the following layers, composition of the respective layers will be given below, were coated in order from the support, to prepare a multi-layer light-sensitive color photographic material 1.

| | |
|---|---|
| First Layer: Anti-halation layer (HC) | |
| Black colloidal silver | 0.15 g |
| UV absorbent (UV-1) | 0.20 g |
| Cornpound (CC-1) | 0.02 g |
| High boiling point solvent (Oil-1) | 0.20 g |
| High boiling point solvent (Oil-2) | 0.20 g |
| Gelatin | 1.6 g |
| Second layer: Intermediate layer (IL-1) | |
| Gelatin | 1.3 g |
| Third layer: Lower red-sensitive emulsion layer (R-L) | |
| Silver iodobromide emulsion (average grain size: 0.3 $\mu$m; average iodide content: 2.0%) | 0.4 g |
| Silver iodobromide emulsion (average grain size: 0.4 $\mu$m; average iodide content: 8.0%) | 0.3 g |
| Sensitizing dye (S-1) 3.2 × $10^{-4}$ (mol/l mol silver) | |
| Sensitizing dye (S-2) 3.2 × $10^{-4}$ (mol/l mol silver) | |
| Sensitizing dye (S--3) 0.2 × $10^{-4}$ (mol/l mol silver) | |
| Cyan dye-forming coupler (C-1) | 0.50 g |
| Cyan dye-forming coupler (C-2) | 0.13 g |
| Colored cyan coupler (CC-1) | 0.07 g |

-continued

| | |
|---|---|
| DIR compound (D-1) | 0.006 g |
| DIR compound (D-2) | 0.01 g |
| High boiling point solvent (Oil-1) | 0.55 g |
| Gelatin | 1.0 g |
| Fourth layer: Higher red-sensitive emulsion layer (R-H) | |
| Silver iodobromide emulsion (average grain size: 0.7 $\mu$m; average iodide content: 2.0%) | 0.9 g |
| Sensitizing dye (S-1) 1.7 × $10^{-4}$ (mol/l mol silver) | |
| Sensitizing dye (S-2) 1.6 × $10^{-4}$ (mol/l mol silver) | |
| Sensitizing dye (S-3) 0.1 × $10^{-4}$ (mol/l mol silver) | |
| Cyan dye-forming coupler (C-2) | 0.23 g |
| Colored cyan coupler (CC-1) | 0.03 g |
| DIR compound (D-2) | 0.02 g |
| High boiling point solvent (Oil-1) | 0.25 g |
| Gelatin | 1.0 g |
| Fifth layer: Intermediate layer (IL-2) | |
| Gelatin | 0.8 g |
| Sixth layer: Lower green-sensitive emulsion layer (G-L) | |
| Silver iodobromide emulsion (average grain size: 0.4 $\mu$m; average iodide content: 2.0%) | 0.6 g |
| Silver iodobromide emulsion (average grain size: 0.3 $\mu$m; average iodide content: 2.0%) | 0.2 g |
| Sensitizing dye (S-4) 6.7 × $10^{-4}$ (mol/l mol silver) | |
| Sensitizing dye (S-5) 0.8 × $10^{-4}$ (mol/l mol silver) | |
| Magenta dye-forming coupler (M-a) | 0.35 g |
| Colored magenta coupler (CM-1) | 0.05 g |
| DIR compound (D-3) | 0.02 g |
| Additive 1 | 0.10 g |
| High boiling point solvent (Oil-2) | 0.7 g |
| Gelatin | 1.0 g |
| Seventh Layer: Higher green-sensitive emulsion layer (G-H) | |
| Silver iodobromide emulsion (average grain size: 0.7 $\mu$m; average iodide content: 7.5%) | 0.9 g |
| Sensitizing dye (S-6) 1.1 × $10^{-4}$ (mol/l mol silver) | |
| Sensitizing dye (S-7) 2.0 × $10^{-4}$ (mol/l mol silver) | |
| Sensitizing dye (S-8) 0.3 × $10^{-4}$ (mol/l mol silver) | |
| Magenta dye-forming coupier (M-a) | 0.20 g |
| Colored magenta coupier (CM-1) | 0.02 g |
| DIR compound (D-3) | 0.004 g |
| High boiling point solvent (Oil-2) | 0.35 g |
| Additive 1 | 0.07 g |
| Gelatin | 1.0 g |
| Eighth layer: Yellow filter layer (YC) | |
| Yellow colloidal silver | 0.1 g |
| Additive (SC-1) | 0.12 g |
| High boiling point solvent (Oil-2) | 0.15 g |
| Gelatin | 1.0 g |
| Ninth layer: Lower blue-sensitive emulsion layer (B-L) | |
| Siiver iodobromide emulsion (average grain size: 0.3 $\mu$m; average iodide content: 2.0%) | 0.25 g |
| Silver iodobromide emulsion (average grain size: 0.4 $\mu$m; average iodide content: 8.0%) | 0.25 g |
| Sensitizing dye (S-9) 5.8 × $10^{-4}$ (mol/l mol silver) | |
| Yellow dye-forming coupler (Y-1) | 0.6 g |
| Yellow dye-forming coupler (Y-2) | 0.32 g |
| DIR compound (D-1) | 0.003 g |
| DIR compound (D-2) | 0.006 g |
| High boiling point solvent (Oil-2) | 0.18 g |
| Gelatin | 1.3 g |
| Tenth layer: Higher blue-sensitive emulsion layer (B-H) | |
| Silver iodobromide emulsion (average grain size: 0.8 $\mu$m; average iodide content: 8.5%) | 0.5 g |
| Sensitizing dye (S-10) 3.0 × $10^{-4}$ (mol/l mol silver) | |
| Sensitizing dye (S-11) 1.2 × $10^{-4}$ (mol/l mol silver) | |
| Yellow dye-forming coupler (Y-1) | 0.18 g |
| Yellow dye-forming coupler (Y-2) | 0.1O g |
| High boiling point solvent (Oil-2) | 0.05 g |
| Gelatin | 1.0 g |
| Eleventh layer: First protective layer (PRO-1) | |
| Silver iodobromide emulsion (average grain size: 0.08 $\mu$m) | 0.3 g |
| UV absorbent (UV-1) | 0.07 g |

-continued

| | |
|---|---|
| UV absorbent (UV-2) | 0.10 g |
| High boiling point solvent (Oil-1) | 0.07 g |
| High boiling point solvent (Oil-3) | 0.07 g |
| Gelatin | 0.8 g |
| Twelfth layer: Second protective layer (PRO-2) | |
| Compound (Compound A) | 0.04 g |
| Compound (Compound B) | 0.004 g |
| Polymethyl methacrylate (average grain diameter: 3 μm) | 0.02 g |
| Copolymer of methyl methacrylate: ethyl methacrylate: methacrylic acid (= 3:3:4 by weight); average | 0.13 g |

-continued

| | |
|---|---|
| diameter: 3 μm) | |
| Gelatin | 0.5 g |

The above-mentioned Sample 1 contains in addition to the above, a dispersion aid (Su-1), a coating aid (Su-20, Hardener (H-1), a stabilizer (ST-1) . A preservative (DI-1), anti foggants (AF-1 and AF-2) and dyes (AI-1 and AI-2).

C-1

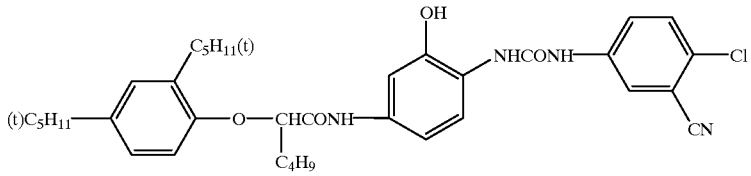

C-2

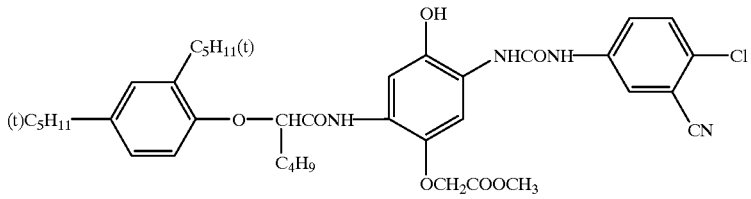

M-1

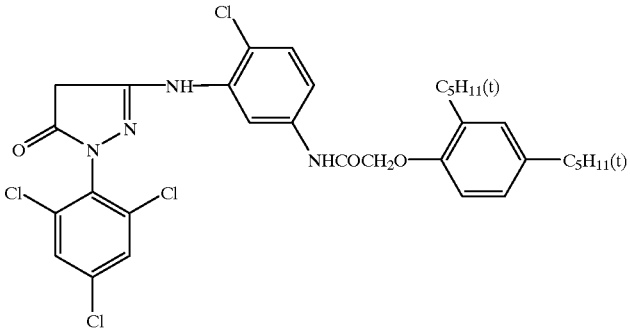

CM-1

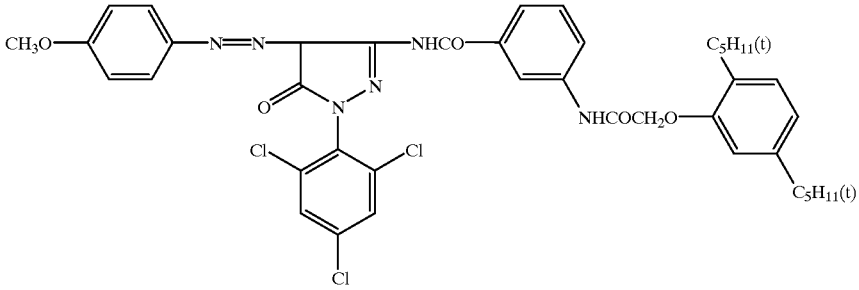

-continued
Y-1
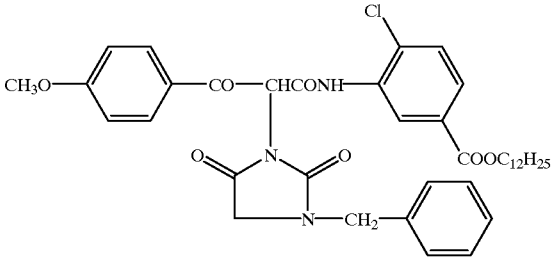
Y-2
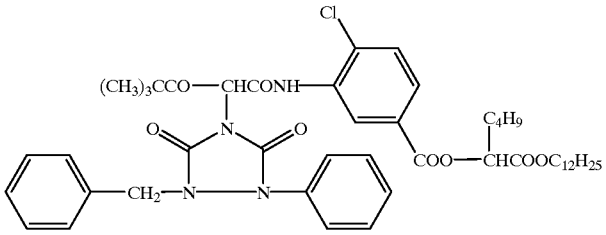
CC-1
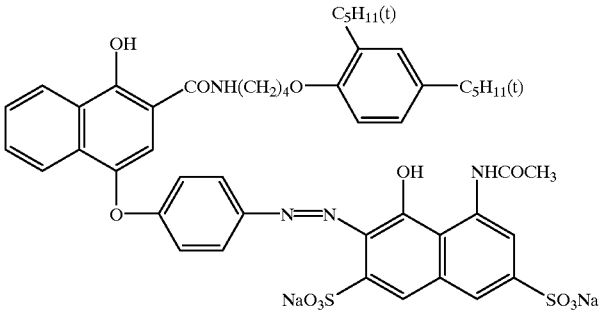
D-1
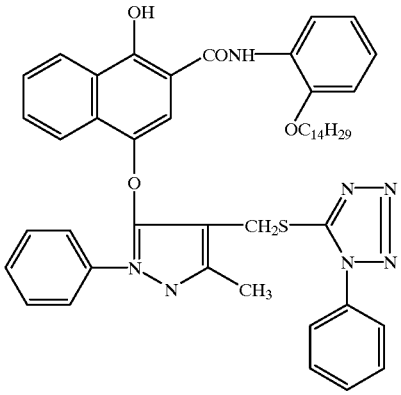
D-2
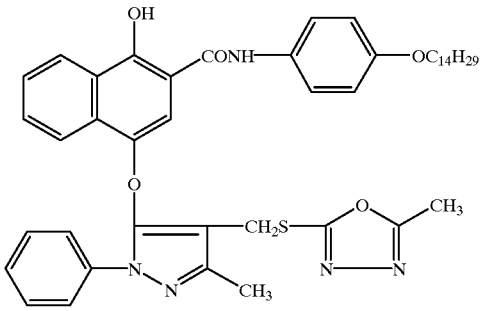

-continued
D-3
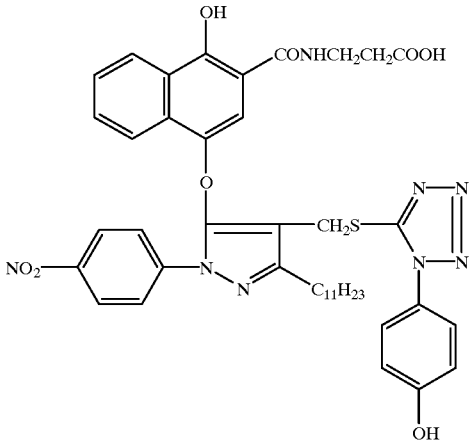
UV-1
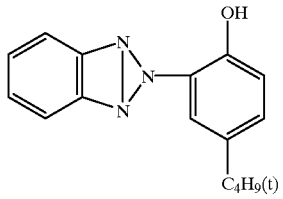
UV-2
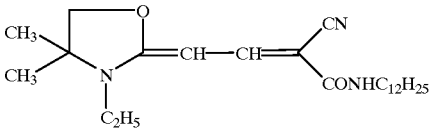
SC-1
mixture of
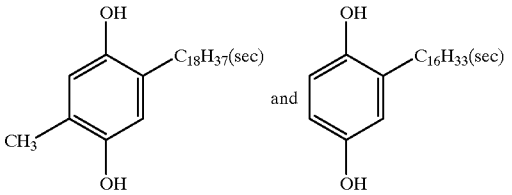
(2:3)
Oil-1
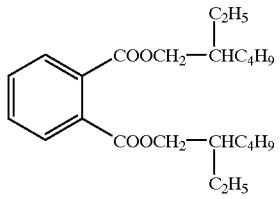
Oil-2
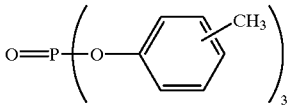
Oil-3
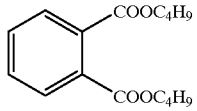

-continued
Compound A
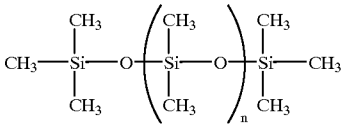
weight average molecular weight = 3,000
Compound B
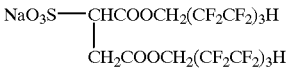
Su-1
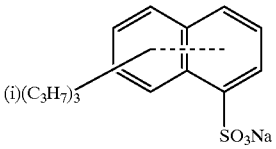
Additive 1
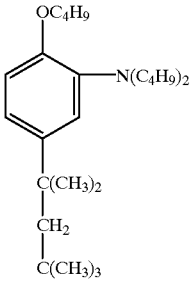
SU-2
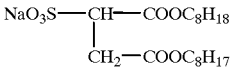
S-1
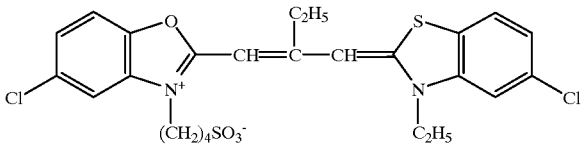
S-2
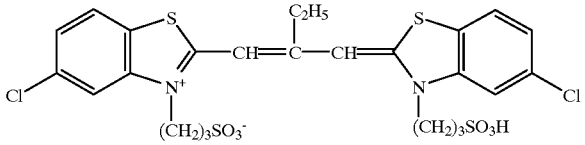
S-3
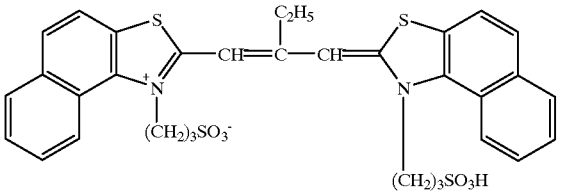
S-4
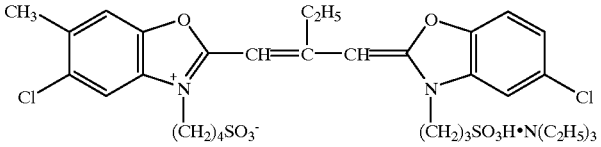

-continued
S-5
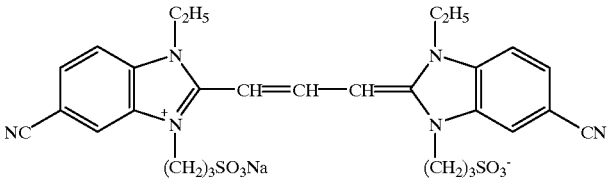
S-6
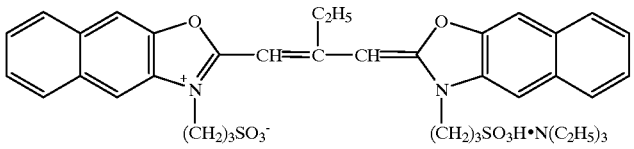
S-7
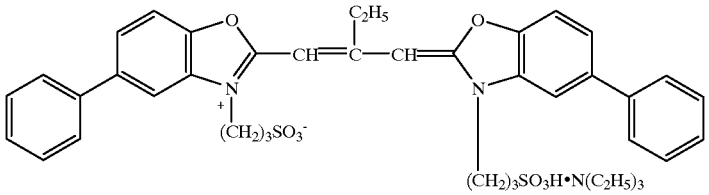
S-8
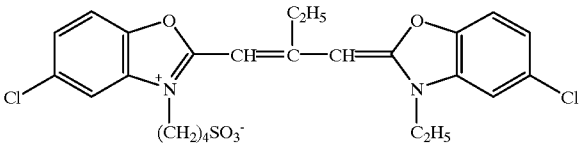
S-9
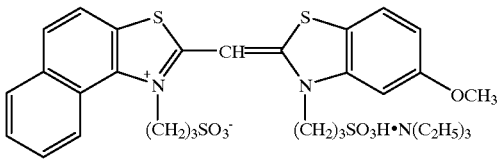
S-10
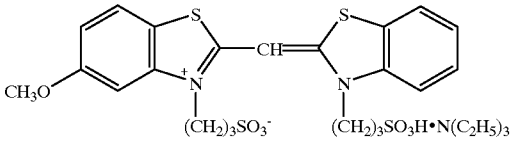
S-11
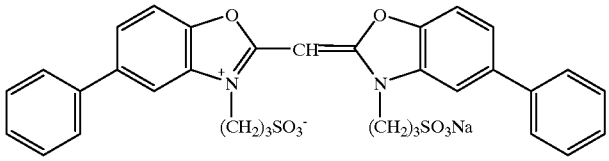
H-1
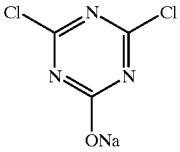
ST-1
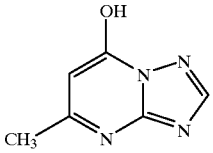

-continued

DI-1

Mixture of

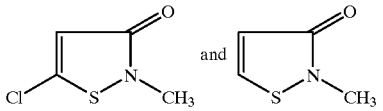

AF-1

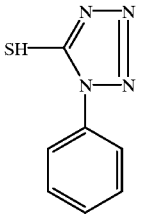

AF-2

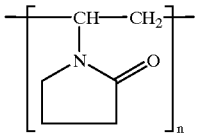

$\overline{Mw}$ = 9,000

AI-1

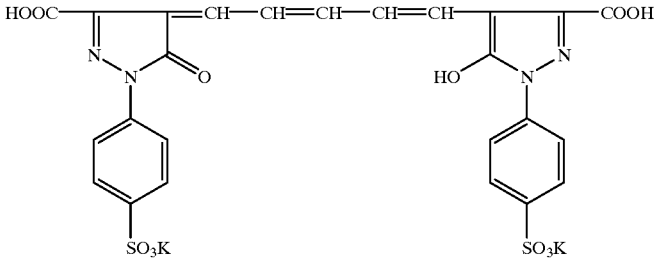

AI-2

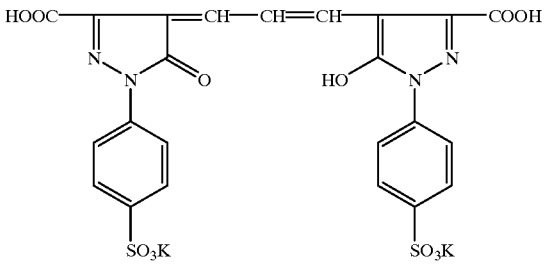

Next, Samples 22 through 33 were prepared in the same manner as in Sample 21, provided that in these samples the magenta dye-forming coupler to be added to the sixth and the seventh layers were varied as shown in Table 4 shown below.

Herein, added amount of magenta dye-forming coupler added to Samples 22–33 was half as much as that added to Sample 21. Further, Additive 1 was not added to the samples according to the invention.

M-b (Comparative Coupler)
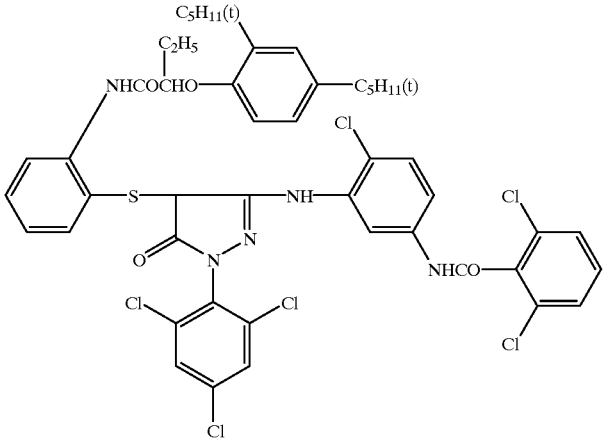
M-c (Comparative coupler)
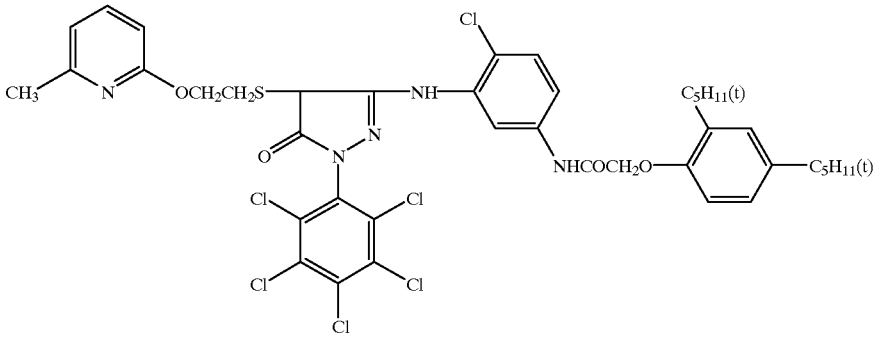
M-d (Comparative coupler)
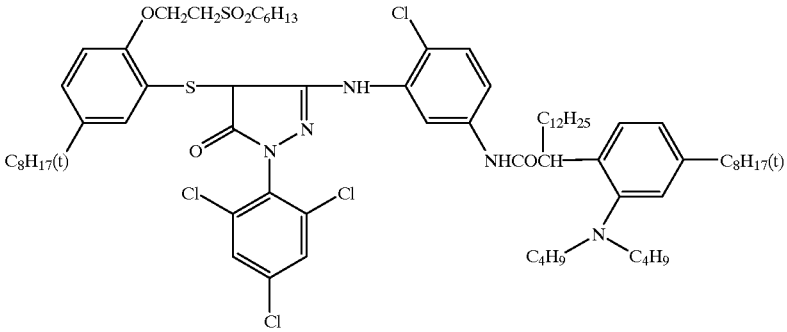
M-e (Comparative coupler)
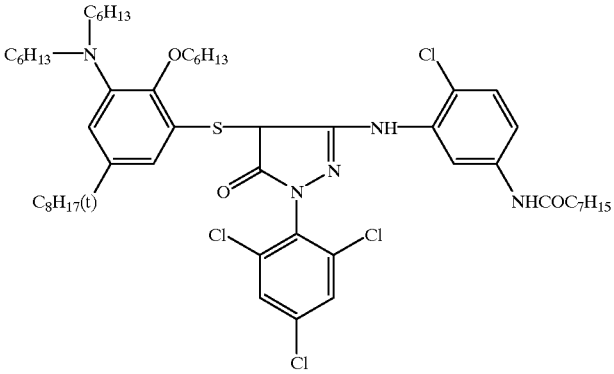

-continued

M-f (Comparative coupler)

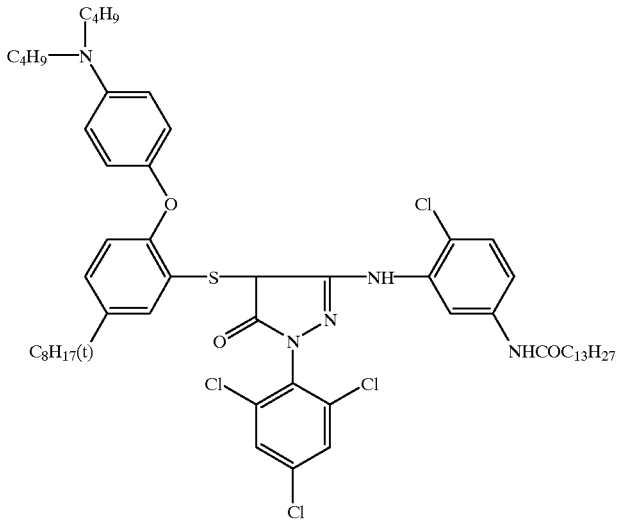

M-g (Comparative coupler)

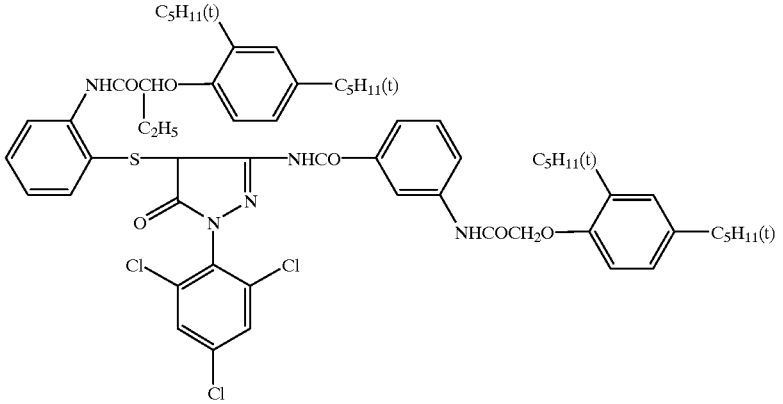

The thus prepared Samples 1 through 15 were subjected to exposure to green light through a stepwedge for sensitometry and, then, processed under the following conditions.

Processing Steps

TABLE 1

| Processing Step | Time | Temperature (° C.) | Amount of Replenishment (ml) |
|---|---|---|---|
| Color Development | 3'15" | 38 | 780 |
| Bleaching | 45" | 38 | 150 |
| Fixing | 1'30" | 38 | 830 |
| Stabilization | 60" | 38 | 830 |
| Dry | 1' | 38 | — |

Note) In the Table, amount of replenishment denotes a value per 1 $m^2$ of light-sensitive material.

Developing solution, bleaching solution fixing solution and stabilizing solutions are as follows.

| Color developing solution | |
|---|---|
| Water | 800 ml |
| Potassium carbonate | 30 g |
| Sodium hydrogen carbonate | 2.5 g |

-continued

| Color developing solution | |
|---|---|
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-Amino-3-methyl-N-ethyl-N-(β-hydroxylethyl)aniline sulfate | 4.5 g |
| Diethylenetriaminepentaacetic acid | 3.0 g |
| Potassium hydroxide | 1.2 g |

Add water to make the total volume to be 1 titer, and adjust pH at 10.06 using potassium hydroxide or 20% sulfuric acid.

| Replenisher for color developing solution | |
|---|---|
| Water | 800 ml |
| Potassium carbonate | 35 g |
| Sodium hydrogen carbonate | 3 g |
| Potassium sulfite | 5 g |
| Sodium bromide | 0.4 g |
| Hydroxylamine sulfate | 3.1 g |
| 4-Amino-3-methyl-N-ethyl-N-(β-hydroxyethyl)aniline sulfate | 6.3 g |

-continued

| Replenisher for color developing solution | |
|---|---|
| Potassium hydroxide | 2 g |
| Diethylenetriaminepentaacetic acid | 3.0 g |

Add water to make the total volume to be 1 liter, and adjust pH at 10.18 using potassium hydroxide or 20% sulfuric acid.

| Bleach solution | |
|---|---|
| water | 700 ml |
| Ferric ammonium 1,3-diaminopropanetetraacettate | 125 g |
| Ethylenediaminetetraacetic acid | 2 g |
| Sodium nitrate | 40 g |
| Ammonium bromide | 150 g |
| glacial acetic acid | 40 g |

Add water to make the total volume to be 1 liter, and adjust pH with ammoniacal water or glacial acetic acid at 4.4.

| Replenisher for bleaching solution | |
|---|---|
| Water | 700 ml |
| Ferric ammonium 1,3-diaminopropanetetraacettate | 175 g |
| Ethylenediaminetetraacetic acid | 2 g |
| Sodium nitrate | 50 g |
| Ammonium bromide | 200 g |
| Glacial acetic acid | 56 g |

After adjusting pH with ammoniacal water or glacial acetic acid at 4.0, add water to make the total volume to be 1 liter.

| Fixing solution | |
|---|---|
| Water | 800 ml |
| Ammonium thiocyanate | 120 g |
| Ammonium thiosulfate | 150 g |
| Sodium sulfite | 15 g |
| Ethylenediaminetetraacetic acid | 2 g |

After adjusting pH with glacial acetic acid or ammoniacal water at 6.2, add water to make the total volume to be 1 liter.

| Replenisher for fixing solution | |
|---|---|
| Water | 800 ml |
| Ammonium thiocyanate | 150 g |
| Ammonium thiosulfate | 180 g |
| Sodium sulfite | 20 g |
| Ethylenediaminetetraacetic acid | 2 g |

After adjusting pH with glacial acetic acid or ammoniacal water at 6.5, add water to make the total volume to be 1 liter.

| Stabilizing solution and Replenisher therefor | |
|---|---|
| Water | 900 ml |
| $p\text{-}C_8H_{17}—C_6H_4—O—(CH_2CH_2O)_{10}H$ | 2.0 g |
| Dimethylol urea | 0.5 g |
| Hexamethylenetetramine | 0.2 g |
| 1,2-Benzthiazoline-3-one | 0.1 g |
| Siloxane (a product of UCC, L-77) | 0.1 g |
| Ammoniacal water | 0.5 ml |

After adding water, to make the total volume to be 1 liter, adjust pH at 8.5 with ammoniacal water or 50% sulfuric acid.

After carrying out processing, sensitometric properties with green light were measured, with respect to respective samples. Bleach fogging was evaluated by measuring density difference (ΔDmin) in the non-exposed portion between when a sample is processed with the above-mentioned bleach solution and the same when it is processed using the following fatigue bleach solution. Sensitivity was obtained from the reciprocal exposure value necessary to give density of fog +0.3, to the sample, and relative sensitivity of the samples are shown in Table 2, in which sensitivity of Sample 1 is normalized as to be 100.

Color reproduction

Color reproduction performance was evaluated by comparing the samples by visual observation after taking the Macbeth Color Chart using the sample light-sensitive materials and printing them on Konica Color paper QA-A6 (a product of Konica Corporation). Evaluation was made in three grades as follows:

A: Good; B: Fair; C: Poor

Light Durability light with 40,000 lux was irradiated to the respective samples for 24 hours and remaining ratio of the image dye at the portion, where optical density is 1.0 was measured. This was estimated as light durability.

Bleach fogging

A fatigue bleaching solution was prepared by adjusting pH of the above-mentioned bleaching solution at 5.5 and diluting it by 1.5 times with water. Bleach fogging was represented by density difference (ΔDmin) in the minimum density (ΔDmin.) between when the sample was processed with the above-mentioned standard bleach solution and when it was processed with the fatigue bleaching solution.

ΔDmin=Dmin (fatigue bleaching solution)−Dmin (standard bleaching solution)

The color developing solution with low pH value for the purpose of evaluating anti-pH fluctuation property was prepared by adjusting pH of the above-mentioned color developing solution at 9.88 with potassium hydroxide or 20% sulfuric acid.

Anti-pH fluctuation property was evaluated by obtaining density difference in the maximum density (ΔDmax) between when the sample was processed with a developer with pH of 10.18 and when it is processed with one with pH of 9.88.

ΔDmax=Dmax (Developer pH=10.18)−Dmax (Developer pH=9.88)

TABLE 2

| Compound | ΔDmin | Relative Sensitivity | Color Reproduction | Anti-light-Degradation | Dmax | ΔDmax | Sample No. |
|---|---|---|---|---|---|---|---|
| Comparative (a) | 0.01 | 100 | C | 91% | 1.85 | 0.20 | 1 |
| Comparative (b) | 0.03 | 170 | C | 88% | 2.20 | 0.02 | 2 |
| Comparative (c) | 0.03 | 115 | A | 87% | 1.80 | 0.02 | 3 |
| Comparative (d) | 0.03 | 150 | C | 91% | 1.75 | 0.02 | 4 |
| Comparative (e) | 0.03 | 170 | C | 90% | 1.80 | 0.02 | 5 |
| Comparative (f) | 0.03 | 170 | C | 91% | 1.90 | 0.02 | 6 |
| Comparative (g) | 0.01 | 100 | A | 89% | 1.30 | 0.13 | 7 |
| Exemplified 1 | 0.01 | 235 | A | 93% | 2.15 | 0.02 | 8 |
| Exemplified 2 | 0.01 | 240 | A | 93% | 2.20 | 0.02 | 9 |
| Exemplified 3 | 0.01 | 230 | A | 93% | 2.10 | 0.02 | 10 |
| Exemplified 4 | 0.01 | 230 | A | 93% | 2.10 | 0.02 | 11 |
| Exemplified 7 | 0.01 | 235 | A | 93% | 2.15 | 0.02 | 12 |
| Exemplified 10 | 0.01 | 220 | B | 92% | 2.20 | 0.02 | 13 |
| Exemplified 11 | 0.01 | 210 | A | 93% | 2.05 | 0.02 | 14 |
| Exemplified 12 | 0.01 | 200 | A | 92% | 2.00 | 0.02 | 15 |

It is obvious from Table 2 that Comparative Samples 1 through 7 have relatively larger bleach fogging (ADmin), lower sensitivity, degraded tone reproduction property and anti-light durability, lower Dmax and larger pH fluctuation.

Whereas, Samples 8 through 15, in which the couplers were used, had less bleach fogging (ΔDmin), higher sensitivity, better color reproduction performance, superior light durability, larger Dmax and less pH fluctuation of the developing solution. Moreover, the couplers in accordance with the present invention, as compared with comparative samples, there is no necessity for Compound 1 to be used. Further, according to the present invention, since relatively larger maximum density can be obtained, it became possible to design light-sensitive materials with reduced thickness, and enhanced sharpness and high cost performance.

Example 2

Next, examples in accordance with the invention claimed in claims 26 through 31 are mentioned.

One surfaces of a cellulose triacetate film was subjected to subbing treatment. Subsequently, on the opposite surface (rear surface) of the support with respect to said subbed surface, the following layers were coated in order, to prepare a support with subbing treatment. Herein, added amount is shown in terms of weight per 1 $m^2$.

| First layer (Rear surface) | |
|---|---|
| Alumina sol AS 100 (aluminum oxide) (a product of Nissan Chemical Industries, Co., Ltd.) | 0.1 g |
| Diacetyl cellulose | 0.2 g |

-continued

| Second layer (rear surface) | |
|---|---|
| Diacetyl cellulose | 100 mg |
| Stearic acid | 10 mg |
| Silica fine powder (average diameter: 0.2 μm) | 50 mg |

On one surface of a subbed cellulose triacetate film support, the following layers, composition of the respective layers were given below, were coated in order from the support, to prepare a multi-layer light-sensitive color photographic material 21.

| First Layer: Anti-halation layer (HC) | |
|---|---|
| Black colloidal silver | 0.15 g |
| UV absorbent (UV-1) | 0.20 g |
| Compound (CC-1) | 0.02 g |
| High boiling point solvent (Oil-1) | 0.20 g |
| High boiling point solvent (Oil-2) | 0.20 g |
| Gelatin | 1.6 g |
| **Second layer: Intermediate layer (IL-1)** | |
| Gelatin | 1.3 g |
| **Third layer: Lower red-sensitive emulsion layer (R-L)** | |
| Silver iodobromide emulsion (average grain size: 0.3 μm; average iodide content: 2.0%) | 0.4 g |
| Silver iodobromide emulsion (average grain size: 0.4 μm; average iodide content: 8.0%) | 0.3 g |
| Sensitizing dye (S-1) $3.2 \times 10^{-4}$ (mol/l mol silver) | |
| Sensitizing dye (S-2) $3.2 \times 10^{-4}$ (mol/l mol silver) | |
| Sensitizing dye (S-3) $0.2 \times 10^{-4}$ (mol/l mol silver) | |
| Cyan dye-forming coupler (C-1) | 0.50 g |
| Cyan dye-forming coupler (C-2) | 0.13 g |

-continued

| | |
|---|---|
| Colored cyan coupler (CC-1) | 0.07 g |
| DIR compound (D-1) | 0.006 g |
| DIR compound (D-2) | 0.01 g |
| High boiling point soivent (Oil-1) | 0.55 g |
| Gelatin | 1.0 g |
| Fourth layer: Higher red-sensitive emulsion layer (R-H) | |
| Silver iodobromide emulsion (average grain size: 0.7 μm; average iodide content: 7.5%) | 0.9 g |
| Sensitizing dye (S-1) $1.7 \times 10^{-4}$ (mol/l mol silver) | |
| Sensitizing dye (S-2) $1.6 \times 10^{-4}$ (mol/l mol silver) | |
| Sensitizing dye (S-3) $0.1 \times 10^{-4}$ (mol/l mol silver) | |
| Cyan dye-forming coupler (C-2) | 0.23 g |
| Colored cyan coupler (CC-1) | 0.03 g |
| DIR compound (D-2) | 0.02 g |
| High boiling point solvent (Oil-1) | 0.25 g |
| Gelatin | 1.0 g |
| Fifth layer: Intermediate layer (IL-2) | |
| Gelatin | 0.8 g |
| Sixth layer: Lower green-sensitive emulsion layer (G-L) | |
| Silver iodobromide emulsion (average grain size: 0.4 μm; average iodide content: 8.0%) | 0.6 g |
| Silver iodobromide emulsion (average grain size: 0.3 μm; average iodide content: 2.0%) | 0.2 g |
| Sensitizing dye (S-4) $6.7 \times 10^{-4}$ (mol/l mol silver) | |
| Sensitizing dye (S-5) $0.8 \times 10^{-4}$ (mol/l mol silver) | |
| Magenta dye-forming coupler (M-a) | 0.35 g |
| Colored magenta coupler (CM-1) | 0.05 g |
| DIR compound (D-3) | 0.02 g |
| Additive 1 | 0.10 g |
| High boiling point solvent (Oil-2) | 0.7 g |
| Gelatin | 1.0 g |
| Seventh layer: Higher green-sensitive emulsion layer (G-H) | |
| Silver iodobromide emulsion (average grain size: 0.7 μm; average iodide content: 7.5%) | 0.9 g |
| Sensitizing dye (S-6) $1.1 \times 10^{-4}$ (mol/l mol silver) | |
| Sensitizing dye (S-7) $2.0 \times 10^{-4}$ (mol/l mol silver) | |
| Sensitizing dye (S-8) $0.3 \times 10^{-4}$ (mol/l mol silver) | |
| Magenta dye-forming coupler (M-a) | 0.20 g |
| Colored magenta coupler (CM-1) | 0.02 g |
| DIR compound (D-3) | 0.004 g |
| High boiling point solvent (Oil-2) | 0.35 g |
| Additive 1 | 0.07 g |
| Gelatin | 1.0 g |
| Eighth layer: Yellow filter layer (YC) | |
| Yellow colloidal silver | 0.1 g |
| Additive (SC-1) | 0.12 g |
| High boiling point solvent (Oil-2) | 0.15 g |
| Gelatin | 1.0 g |
| Ninth layer: Lower blue-sensitive emulsion layer (B-L) | |
| Silver iodobromide emulsion (average grain size: 0.3 μm; average iodide content: 2.0%) | 0.25 g |
| Silver iodobromide emulsion (average grain size: 0.4 μm; average iodide content: 8.0%) | 0.25 g |
| Sensitizing dye (S-9) $5.8 \times 10^{-4}$ (mol/l mol silver) | |
| Yellow dye-forming coupler (Y-1) | 0.6 g |

-continued

| | |
|---|---|
| Yellow dye-forming coupler (Y-2) | 0.32 g |
| DIR compound (D-1) | 0.003 g |
| DIR compound (D-2) | 0.006 g |
| High boiling point solvent (Oil-2) | 0.18 g |
| Gelatin | 1.3 g |
| Tenth layer: Higher blue-sensitive emulsion layer (B-H) | |
| Silver iodobromide emulsion (average grain size: 0.8 μm; average iodide content: 8.5%) | 0.5 g |
| Sensitizing dye (S-10) $3.0 \times 10^{-4}$ (mol/l mol silver) | |
| Sensitizing dye (S-11) $1.2 \times 10^{-4}$ (mol/l mol silver) | |
| Yellow dye-forming coupler (Y-1) | 0.18 g |
| Yellow dye-forming coupler (Y-2) | 0.10 g |
| High boiling point solvent (Oil-2) | 0.05 g |
| Gelatin | 1.0 g |
| Eleventh layer: First protective layer (PRO-1) | |
| Silver iodobromide emulsion (average grain size: 0.08 μm) | 0.3 g |
| UV absorbent (UV-1) | 0.07 g |
| UV absorbent (UV-2) | 0.10 g |
| High boiling point solvent (Oil-1) | 0.07 g |
| High boiling point solvent (Oil-3) | 0.07 g |
| Gelatin | 0.8 g |
| Twelfth layer: Second protective layer (PRO-2) | |
| Compound (Compound A) | 0.04 g |
| Compound (Compound B) | 0.004 g |
| Polymethyl methacrylate (average grain diameter: 3 μm) | 0.02 g |
| Copolymer of methyl methacrylate: ethyl methacrylate: methacrylic acid (= 3:3:4 by weight); average diameter: 3 μm) | 0.13 g |
| Gelatin | 0.5 g |

The above-mentioned Sample 1 contains in addition to the above, a dispersion aid (Su-1), a coating aid (Su-2), Hardener (H-1), a stabilizer (ST-1). a preservative (DI-1), anti foggants (AF-1 and AF-2) and dyes (AI-1 and AI-2).

M-h (Comparative coupler)
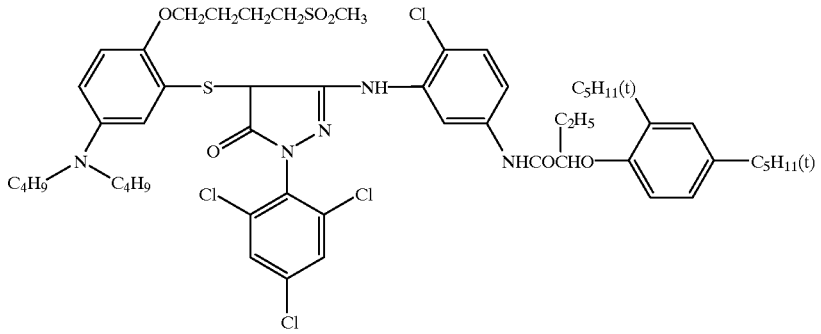
M-i (Comparative coupler)
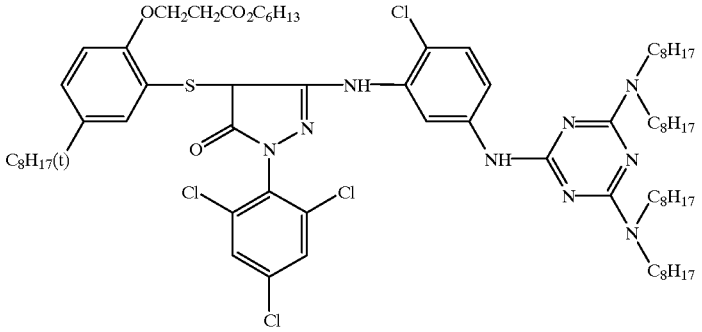
M-j (Comparative coupler)
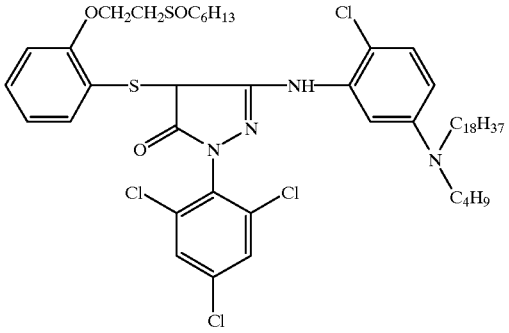
M-k (Comparative coupler)
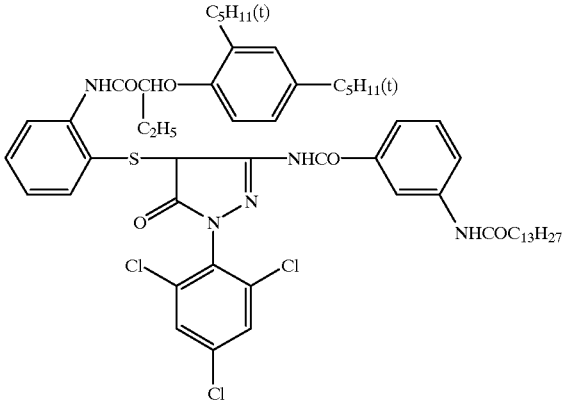

-continued

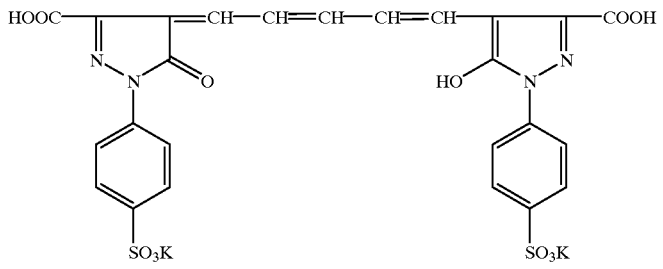

Al-1

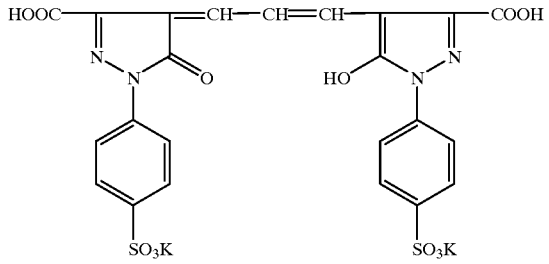

Al-2

Next, Samples 22 through 33 were prepared in the same manner as Sample 21, provided that in these samples the magenta dye-forming coupler to be added to the sixth and the seventh layers were varied as shown in Table 4 shown below.

Herein, added amount of magenta dye-forming coupler added to Samples 2–15 was half as much as that added to Sample 1. Further, Additive 1 was not added to the samples according to the invention.

The thus prepared Samples 1 through 15 were subjected to exposure to green light through a stepwedge for sensitometry and, then, processed under the following conditions.

Processing Steps

TABLE 3

| Processing Step | Time | Temperature (°C.) | Amount of Replenishment (ml) |
|---|---|---|---|
| Color Development | 3'15' | 38 ± 0.3 | 780 |
| Bleaching | 45" | 38 ± 2.0 | 150 |
| Fixing | 1'30" | 38 ± 2.0 | 830 |
| Stabilization | 60" | 38 ± 5.0 | 830 |
| Dry | 1' | 38 ± 5.0 | — |

Note) In the Table, amount of replenishment denotes a value per 1 $m^2$ of light-sensitive material.

Developing solution, bleaching solution fixing solution and stabilizing solutions are as follows.

| Color developing solution | |
|---|---|
| Water | 800 ml |
| Potassium carbonate | 30 g |
| Sodium hydrogen cabonate | 2.5 g |
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-amino-3-methyl-N-ethyl-N-(β-hydroxylethyl)aniline sulfate | 4.5 g |

-continued

| Color developing solution | |
|---|---|
| Diethylenetriaminepentaacetic acid | 3.0 g |
| Potassium hydroxide | 1.2 g |

Add water to make the total volume to be 1 liter, and adjust pH at 10.06 using potassium hydroxide or 20% sulfuric acid.

| Replenisher for color developing solution | |
|---|---|
| Water | 800 ml |
| Potassium carbonate | 35 g |
| Sodium hydrogen carbonate | 3 g |
| Potassium sulfite | 5 g |
| Sodium bromide | 0.4 g |
| Hydroxylamine sulfate | 3.1 g |
| 4-Amino-3-methyl-N-ethyl-N-(β-hydroxylethyl)aniline sulfate | 6.3 g |
| Potassium hydroxide | 2 g |
| Diethylenetriaminepentaacetic acid | 3.0 g |

Add water to make the total volume to be 1 liter, and adjust pH at 10.18 using potassium hydroxide or 20% sulfiric acid.

Bleaching solution water 700 ml

Ferric ammonium 1,3-diaminopropanetetraacettate 125 g

Ethylenediaminetetraacetic acid 2 g

Sodium nitrate 40 g

Ammonium bromide 150 g glacial acetic acid 40 g

Add water to make the total volume to be 1 liter, and adjust pH with ammoniacal water or glacial acetic acid at 4.4.

| Replenisher for bleaching solution | |
|---|---|
| water | 700 ml |
| Ferric ammonium1,3-diaminopropanetetraacettate | 175 g |

-continued

| Replenisher for bleaching solution | |
|---|---|
| Ethylenediaminetetraacetic acid | 2 g |
| Sodium nitrate | 50 g |
| Ammonium bromide | 200 g |
| glacial acetic acid | 56 g |

After adjusting pH with ammoniacal water or glacial acetic acid at 4.0, add water to make the total volume to be 1 liter.

| Fixing solution | |
|---|---|
| Water | 800 ml |
| Ammonium thiocyanate | 120 g |
| Ammonium thiosulfate | 150 g |
| Sodium sulfite | 15 g |
| Ethylenediaminetetraacetic acid | 2 g |

After adjusting pH with glacial acetic acid or ammoniacal water at 6.2, add water to make the total volume to be 1 liter.

| Replenisher for fixing solution | |
|---|---|
| Water | 800 ml |
| Ammonium thiocyanate | 150 g |
| Ammonium thiosulfate | 180 g |
| Sodium sulfite | 20 g |
| Ethylenediaminetetraacetic acid | 2 g |

After adjusting pH with glacial acetic acid or ammoniacal water at 6.5, add water to make the total volume to be 1 liter.

| Stabilizing solution and Replenisher therefor | |
|---|---|
| Water | 900 ml |
| p-$C_8H_{17}$—$C_6H_4$—O—$(CH_2CH_2O)_{10}H$ | 2.0 g |
| Dimethylol urea | 0.5 g |
| Hexamethylenetetramine | 0.2 g |
| 1,2-Benzthiazoline-3-one | 0.1 g |
| Siloxane (a product of UCC, L-77) | 0.1 g |
| Ammoniacal water | 0.5 ml |

After adding water, to make the total volume to be 1 liter, adjust pH at 8.5 with ammoniacal water or 50% sulfuric acid.

After carrying out processing, sensitometric properties with green light were measured with respect to respective samples. Bleach fogging was evaluated by measuring density difference (ΔDmin) in the non-exposed portion between when a sample is processed with the above-mentioned bleaching solution and the same when it is processed using the following fatigue bleaching solution. Sensitivity was obtained from the reciprocal exposure value necessary to give density of fog +0.3, to the sample, and relative sensitivities of the samples are shown in Table 4, in which sensitivity of Sample 1 is normalized as to be 100.

Light Durability light with 40,000 lux was irradiated to the respective samples for 24 hours and remaining ratio of the image dye at the portion, where optical density is 1.0 was measured. This was estimated as light durability.

Bleach fogging

A fatigue bleaching solution was prepared by adjusting pH of the above-mentioned bleaching solution at 5.5 and diluting it by 1.5 times with water. Bleach fogging was represented by density difference (ΔDmin) in the minimum density (ΔDmin.) between when the sample was processed with the above-mentioned standard bleaching solution and when it was processed with the fatigue bleaching solution.

ΔDmin=Dmin (fatigue bleaching solution)−Dmin (standard bleaching solution)

The color developing solution with low pH value for the purpose of evaluating anti-pH fluctuation property was prepared by adjusting pH of the above-mentioned color developing solution at 9.88 with potassium hydroxide or 20% sulfuric acid.

Anti-pH fluctuation property

Anti-pH fluctuation property was evaluated by obtaining density difference in the maximum density (ΔDmax) between when the sample was processed with a developer with pH of 10.18 and when it is processed with one with pH of 9.88.

ΔDmax=Dmax (Developer pH=10.18)−Dmax (Developer pH=9.88)

Adaptability to processing with hard water

A hard water color developing solution was prepared by adding 1.5 g per 1 liter of calcium niteate to the above-mentioned color developing solution. The maximum density obtained by the color developing solution was made to be 100 and relative maximum density value when obtained with the hard water color developing solution was obtained. Results are shown in Table 4.

TABLE 4

| Sample No. | Compound | Relative Sensitivity | ΔDmax | Anti-light Degradation | Bleach Fogging | Adaptability to Hard Water Processing | Additive 1. |
|---|---|---|---|---|---|---|---|
| 21 | Comparative (a) | 100 | 1.80 | 90% | 0.01 | 98 | Yes |
| 22 | Comparative (b) | 170 | 2.20 | 88% | 0.03 | 99 | Yes |
| 23 | Comparative (b) | 180 | 2.30 | 60% | 0.20 | 99 | No |
| 24 | Comparative (h) | 190 | 2.00 | 81% | 0.03 | 90 | Yes |
| 25 | Comparative (d) | 190 | 1.95 | 89% | 0.02 | 90 | Yes |
| 26 | Comparative (i) | 180 | 1.90 | 86% | 0.03 | 88 | Yes |
| 27 | Comparative (j) | 195 | 2.00 | 90% | 0.02 | 89 | Yes |
| 28 | Comparative (f) | 195 | 1.90 | 85% | 0.03 | 91 | Yes |
| 29 | Comparative (k) | 170 | 2.20 | 80% | 0.03 | 96 | Yes |
| 30 | Exemplified 2 | 240 | 2.20 | 93% | 0.01 | 98 | No |
| 31 | Exemplified 9 | 245 | 2.15 | 94% | 0.01 | 99 | No |
| 32 | Exemplified 15 | 250 | 2.20 | 95% | 0.01 | 99 | No |
| 33 | Exemplified 18 | 245 | 2.15 | 94% | 0.01 | 98 | No |

It is obvious from Table 4 that Comparative Samples 21 through 29 have relatively larger bleach fogging (ΔDmin), lower sensitivity, degraded anti-light durability and adaptability to processing with a hard water color developkng solution.

Whereas, Samples 30 through 33, in which the couplers in accordance with the present invention were used, had less bleach fogging (ΔDmin), higher sensitivity, better color reproduction performance, superior light durability, larger Dmax and less pH fluctuation of the developing solution. Moreover, couplers in accordance with the present invention, as compared with Comparative Samples, there is no necessity for Compound 1 to be used. Further, according to the present invention, since relatively larger maximum density can be obtained, it became possible to design light-sensitive materials with reduced thickness, and enhanced sharpness and cost performance.

Example 3

Sample 31 was prepared in the same manner as in Sample 21 in Example 2, provided in this sample, the yellow-dye-forming coupler was replaced by equivalent molar amount of Exemplified coupler 27.

Sample Nos. 21 and 31 were exposed to blue light through a sensitometric step wedge and were processed in the same manner as in Example 2. After processing, these samples were subjected to sensitometric measurements in the same manner as in Example 2, to obtain bleach fogging (ΔDmin). Bleach fogging of Samples 21 and 31 were 0.20 and 0.03, respectively and, thus the effect of the present invention was obtained.

According to the present invention, it became possible to provide a silver halide light-sensitive color photographic material having, firstly, enhanced sensitivity with reduced bleach fogging; secondly, a silver halide light-sensitive color photographic material having superior color reproduction performance and durability against light; thirdly, a silver halide light-sensitive color photographic material with reduced film thickness and excellent sharpness; fourthly, a silver halide light-sensitive color photographic material with reduced pH fluctuation in the color developing solution; and, fifthly, a silver halide light-sensitive color photographic material manufacturable with reduced cost performance.

Further in accordance to the present invention, it became possible to provide a silver halide light-sensitive color photographic material having, firstly, enhanced sensitivity with reduced bleach fogging; secondly, a silver halide light-sensitive color photographic material having superior color reproduction performance and durability against light; thirdly, a silver halide light-sensitive color photographic material with reduced film thickness and excellent sharpness; fourthly, a silver halide light-sensitive color photographic material with reduced pH fluctuation in the color developing solution; and, fifthly, a silver halide light-sensitive color photographic material manufacturable with reduced cost performance.

We claim:

1. A silver halide light-sensitive color photographic material comprising on a support photographic constituent layers including a blue-sensitive silver halide emulsion layer, a green-sensitive silver halide emulsion layer and a red-sensitive silver halide emulsion layer, wherein at least one of the photographic constituent layers contains at least one coupler of formula (VII):

(VII)

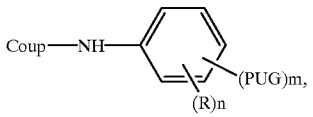

wherein Coup is a pyrazolone group; PUG is a benzoylamino group; R represents a substituent; m represents an integer from 1 to 5; and n represents zero or an integer from 1 to 4, wherein the coupler has a group represented by formula (VII a) at a position other than a coupling point of the coupler, (VII a)

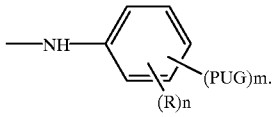

2. The silver halide light-sensitive color photographic material described in claim 1, wherein PUG is an anti-fading agent or a anti-bleach fogging agent.

3. The silver halide light-sensitive color photographic material described in claim 1, wherein Coup is a group represented by formula

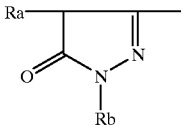

wherein $R_a$ is a group which is capable of splitting off upon reaction with an oxidation product of a developing agent; and $R_b$ represents a non-substituted or substituted aromatic group.

4. The silver halide light-sensitive color photographic material described in claim 3, wherein $R_a$ is an arylthio group which may have a substituent.

5. The silver halide light-sensitive color photographic material described in claim 3, wherein $R_b$ is a group represented by formula

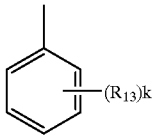

wherein $R_{13}$ is halogen and k represents 4 or 5.

6. The silver halide light-sensitive color photographic material described in claim 4, wherein $R_a$ is an arylthio group substituted by an acylamino group.

7. The silver halide light-sensitive color photographic material described in claim 4, wherein $R_b$ is a pentachlorophenyl group.

8. The silver halide light-sensitive color photographic material described in claim 7, wherein PUG is a group represented by a formula:

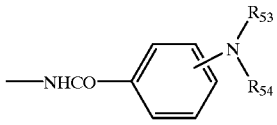

wherein $R_{53}$ and $R_{54}$ independently represent an alkyl group or an aryl group.

* * * * *